US008226278B2

(12) United States Patent
Ward et al.

(10) Patent No.: US 8,226,278 B2
(45) Date of Patent: Jul. 24, 2012

(54) ADJUSTABLE LIGHT FIXTURE

(75) Inventors: Patrick Ward, San Antonio, TX (US); Kevin Wilson, San Antonio, TX (US); Matthew Gates, Schertz, TX (US)

(73) Assignee: Lucifer Lighting Company, San Antonio, TX (US)

( * ) Notice: Subject to any disclaimer, the term of this patent is extended or adjusted under 35 U.S.C. 154(b) by 520 days.

(21) Appl. No.: 12/429,006

(22) Filed: Apr. 23, 2009

(65) Prior Publication Data

US 2009/0268474 A1 Oct. 29, 2009

Related U.S. Application Data

(60) Provisional application No. 61/047,252, filed on Apr. 23, 2008.

(51) Int. Cl.
*F21V 15/01* (2006.01)

(52) U.S. Cl. ..... 362/365; 362/371; 362/419; 362/427

(58) Field of Classification Search ..... 362/285, 362/287, 364, 365, 370, 371, 418, 419, 427
See application file for complete search history.

(56) References Cited

U.S. PATENT DOCUMENTS

| | | | | |
|---|---|---|---|---|
| 4,232,361 | A | 11/1980 | Kelsall | 362/364 |
| 5,562,343 | A | 10/1996 | Chan et al. | 362/365 |
| 6,652,124 | B2 * | 11/2003 | Schubert et al. | 362/285 |
| 7,484,866 | B1 * | 2/2009 | Buse | 362/366 |
| 2004/0042096 | A1 | 3/2004 | Nomura | 359/822 |
| 2006/0250788 | A1 | 11/2006 | Hodge et al. | 362/147 |

OTHER PUBLICATIONS

"Think you know everything downlights have to offer," Focal Point LLC, 2007, available online at http://www.focalpointlights.com/downloads/brochures/ID_Brochure.pdf.

* cited by examiner

*Primary Examiner* — Thomas Sember
(74) *Attorney, Agent, or Firm* — Fulbright & Jaworski L.L.P.

(57) ABSTRACT

Disclosed is an adjustable light fixture. The light fixture can include a housing assembly comprising an outer housing surrounding a central opening; a first adjustment mechanism configured to tilt the light source comprising a first rotating member; and a second adjustment mechanism configured to rotate the light source comprising a second rotating member, where the first and second rotating members are substantially parallel to one another. The light fixture can also include a biasing member that will return the housing assembly to a first tilted position from a second titled position.

13 Claims, 23 Drawing Sheets

ADJUSTABLE LIGHT FIXTURE

CROSS REFERENCE TO RELATED APPLICATION

The present application claims the benefit of U.S. Provisional Application No. 61/047,252 filed Apr. 23, 2008.

BACKGROUND OF THE INVENTION

A. Field of the Invention

The present invention relates generally to adjustable light fixtures.

B. Description of Related Art

Adjustable light fixtures that are currently available can be adjusted by rotating or tilting the light source.

Adjustable light fixtures can be used to light room interiors and wall planes where retail goods, furnishings and art are placed. Maintenance of the light source, that is changing the light source when it no longer operates, can require physical removal of the fixture from the structure and unintended alteration of rotation and/or tilt. Such maintenance can cause the light source on re-installation to be in an orientation different from that which was first aimed.

SUMMARY OF THE INVENTION

The present invention provides an adjustable light fixture. In one embodiment, the light fixture includes an adjustable light fixture comprising a housing assembly with an outer housing surrounding a central opening, a first adjustment mechanism configured to tilt the outer housing comprising a first rotating member, and a second adjustment mechanism configured to rotate the outer housing comprising a second rotating member. In certain instances, the first and second adjustable mechanisms can be accessible when the light fixture is installed in a recessed mounting receptacle. The first and second rotating members can be substantially parallel to one another. The first rotating member can include a first head portion that can be configured to rotate (e.g., clockwise or counter clockwise), where rotation of the first head portion can cause the outer housing to tilt. The second rotating member can include a second head portion that can be configured to rotate (e.g., clockwise or counter clockwise), where rotation of the second head portion can cause the outer housing to rotate. In one aspect of the present invention, the first and second head portions can be on substantially the same plane. Also, the first and second head portions can be configured to be rotated with a hand tool (e.g., screwdriver, pliers, wrench, etc.). The adjustable light fixture can also include a face plate. The face plate can include a surface that includes one, two, three, four, five, six, seven, or more openings. In certain embodiments, there can be one or more openings configured to allow access to the first and second head portions. The face plate can also be configured to remain stationary when an upper portion of the housing assembly rotates. A trim ring can and/or a light source can be included with the light fixture as well. The trim ring can be attached to an opening in the face plate.

Particular embodiments may comprise a trim plate that can be removed while the light fixture is installed, where removal of the trim plate provides access to the first and second adjustment mechanisms. In certain embodiments, the first adjustment member comprises a biasing member configured to bias the outer housing to a first tilted position. In particular embodiments, the outer housing can be tilted to a second tilted position without rotating the first rotating member. In certain embodiments, the outer housing can be tilted from the first tilted position to the second titled position during removal of the adjustable light fixture from a recessed mounting receptacle. In particular embodiments, the first adjustment member comprises an alignment bracket with a slot that engages an engagement pin coupled to the outer housing.

Certain embodiments may comprise a stationary assembly, a housing assembly, and a rotating ring. The stationary assembly may comprise a peripheral wall surrounding a central opening and a gear assembly coupled to the stationary assembly. The housing assembly may comprise an outer housing surrounding a central opening and a threaded bushing coupled to the housing, where a jackscrew is engaged with the threaded bushing. The rotating ring can be disposed between the stationary assembly and the housing assembly, and may comprise an outer ring surrounding a central opening, an opening through the outer ring, and a gear segment on a portion of the outer ring, where the gear assembly is engaged with the gear segment. Specific embodiments may also comprise a plate configured to be coupled to the stationary assembly. The plate may comprise a surface that includes two openings, where each opening is configured to allow access to the head portion of the elongated rod and head portion of the jackscrew.

In certain instances, rotation of the gear assembly causes the rotating ring and the housing assembly to rotate. In specific examples, the rotating ring and housing assembly can rotate in a clockwise or counter clockwise direction. In specific examples, the permissible degree of rotation may be 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, 200, 201, 202, 203, 204, 205, 206, 207, 208, 209, 210, 211, 212, 213, 214, 215, 216, 217, 218, 219, 220, 221, 222, 223, 224, 225, 226, 227, 228, 229, 230, 231, 232, 233, 234, 235, 236, 237, 238, 239, 240, 241, 242, 243, 244, 245, 246, 247, 248, 249, 250, 251, 252, 253, 254, 255, 256, 257, 258, 259, 260, 261, 262, 263, 264, 265, 266, 267, 268, 269, 270, 271, 272, 273, 274, 275, 276, 277, 278, 279, 280, 281, 282, 283, 284, 285, 286, 287, 288, 289, 290, 291, 292, 293, 294, 295, 296, 297, 298, 299, 300, 301, 302, 303, 304, 305, 306, 307, 308, 309, 310, 311, 312, 313, 314, 315, 316, 317, 318, 319, 320, 321, 322, 323, 324, 325, 326, 327, 328, 329, 330, 331, 332, 333, 334, 335, 336, 337, 338, 339, 340, 341, 342, 343, 344, 345, 346, 347, 348, 349, 350, 351, 352, 353, 354, 355, 356, 357, 358, 359, or 360 degrees, or any combination, sub-combination or derivative of these values. In certain embodiments, the gear assembly comprises a gear and an elongated rod. The elongated rod may extend through an opening in the stationary assembly, and the elongated rod may comprise a head portion and rod portion. In specific embodiments, rotating the head portion rotates the gear assembly. In specific instances, the head portion is configured to be rotated with a tool (e.g., a screwdriver, allen wrench, pliers, and/or ratchet).

In certain embodiments, the adjustable light fixture is configured to allow access to the head portion and allow rotation of the head portion after installation of the adjustable light fixture. In specific embodiments, the jackscrew extends through the opening of the outer ring of the rotating member, and rotation of the jackscrew causes the housing assembly to tilt. In specific embodiments, the permissible degree of tilt (in either direction) includes 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, or 90 degrees, or any combination, sub-combination or derivative of these values.

In certain embodiments, the jackscrew comprises a head portion and a rod portion. In specific instances, rotating the head portion tilts the housing assembly. In certain examples, the head portion of the jackscrew is configured to be rotated with a tool (e.g., a screwdriver, allen wrench, pliers, and/or ratchet). In specific embodiments, the adjustable light fixture is installed into a wall, ceiling, floor, display cabinet or other similar locations. The adjustable light fixture may also comprise a light source, and in certain examples, the light emitted by the light source can be rotated by rotating the head portion of the elongated rod and can be tilted by rotating the head portion of the jackscrew. In specific examples, the head portion of the elongated rod and head portion of the jackscrew can be rotated with a tool, including, for example, a screwdriver, allen wrench, pliers, and/or ratchet.

Certain embodiments may comprise an adjustable light fixture comprising a stationary assembly, a housing assembly, and a rotating ring disposed between the stationary assembly and the housing assembly. In specific instances, the stationary assembly comprises a gear assembly which includes a gear and an elongated rod including a head portion and a rod portion, and a peripheral wall surrounding a central opening. In certain embodiments, an inside portion of the peripheral wall comprises a seating area that includes a first portion capable of engaging the gear assembly and a second portion, where the first portion of the seating area comprises an opening capable of receiving the elongated rod. In specific instances, the housing assembly comprises an outer housing surrounding a central opening, and a threaded bushing coupled to the housing, where a jackscrew is engaged with the threaded bushing. The jackscrew may comprise a head portion and a rod portion.

In specific instances, the rotating ring may comprise an outer ring surrounding a central opening, an opening through the outer ring configured to engage the jackscrew, and a gear segment on a portion of the outer ring, where the gear assembly is engaged with the gear segment. In certain examples, the housing assembly can be tilted by rotating the head portion of the jackscrew and where the housing assembly and rotating ring can be rotated by rotating the head portion of the elongated member.

Certain embodiments may include an adjustable light fixture comprising a recessed mounting receptacle and a housing assembly comprising an outer housing, where the housing assembly is configured to be installed in the recessed mounting receptacle. The embodiments may also comprise a first adjustment mechanism comprising a first biasing member, where the first adjustment mechanism is configured to tilt the outer housing to a first tilted position. The embodiments may also comprise a second adjustment mechanism configured to rotate the outer housing to a first rotational position. In certain embodiments, the housing assembly is configured so that while the housing assembly is being removed from the recessed mounting receptacle, the housing assembly can tilt from the first tilted position to a second tilted position. In particular embodiments, the housing assembly is configured so that when the housing assembly is removed from the recessed mounting receptacle, the first biasing member will return the housing assembly to the first tilted position.

In certain embodiments, the second adjustment mechanism comprises: a gear member; a locking member; and a second biasing member configured to bias the gear member towards the locking member. In particular embodiments, the first and second adjustment mechanisms are accessible when the housing assembly is installed in the recessed mounting receptacle. In certain embodiments, the first adjustment member comprises an alignment bracket with a slot that engages an engagement pin coupled to the outer housing. In particular embodiments, the first adjustment mechanism comprises a first rotating member with a first head portion that is configured to rotate, and where rotation of the first head portion causes the housing assembly to tilt.

In certain embodiments, the housing assembly comprises an upper bracket, and the upper bracket is configured for adjustable engagement with the outer housing to allow a user to adjust the distance between upper bracket and the outer housing. Particular embodiments also comprise a trim plate, and a housing assembly that comprises a base ring. In certain embodiments, a biasing member is coupled to the base ring. In particular embodiments, the biasing member comprises a curved portion that extends away from the base ring and trim plate.

The use of the term "or" in the claims is used to mean "and/or" unless explicitly indicated to refer to alternatives only or the alternatives are mutually exclusive, although the disclosure supports a definition that refers to only alternatives and "and/or."

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

Any embodiment of any of the adjustable light fixtures disclosed in the specification may consist of or consist essentially of—rather than comprise/include/contain/have—the described elements and/or features. Thus, in any of the claims, the term "consisting of" or "consisting essentially of" may be substituted for any of the open-ended linking verbs recited above, in order to change the scope of a given claim from what it would otherwise be using the open-ended linking verb.

The term "coupled" is defined as connected, although not necessarily directly, and not necessarily mechanically.

The terms "a" and "an" are defined as one or more unless this disclosure explicitly requires otherwise.

The terms "substantially," "approximately," "about," and variations thereof are defined as being largely but not necessarily wholly what is specified, as understood by a person of ordinary skill in the art. In one non-limiting embodiment, the term substantially refers to ranges within 10%, preferably within 5%, more preferably within 1%, and most preferably within 0.5% of what is specified.

Furthermore, a device or structure that is configured in a certain way is configured in at least that way, but it may also be configured in ways other than those specifically described.

Other objects, features and advantages of the present invention will become apparent from the following detailed description. For purposes of clarity, not every feature shown in each view is labeled with an reference number. It should be understood, however, that the detailed description and the examples, while indicating specific embodiments of the invention, are given by way of illustration only. Additionally, it is contemplated that changes and modifications within the spirit and scope of the invention will become apparent to those skilled in the art from this detailed description.

BRIEF DESCRIPTION OF THE DRAWINGS

The following drawings illustrate by way of example and not limitation. Every feature of a given structure is not always labeled in every figure in which that structure appears, in order to keep the figures clear.

DESCRIPTION OF ILLUSTRATIVE EMBODIMENTS

Figure 1:
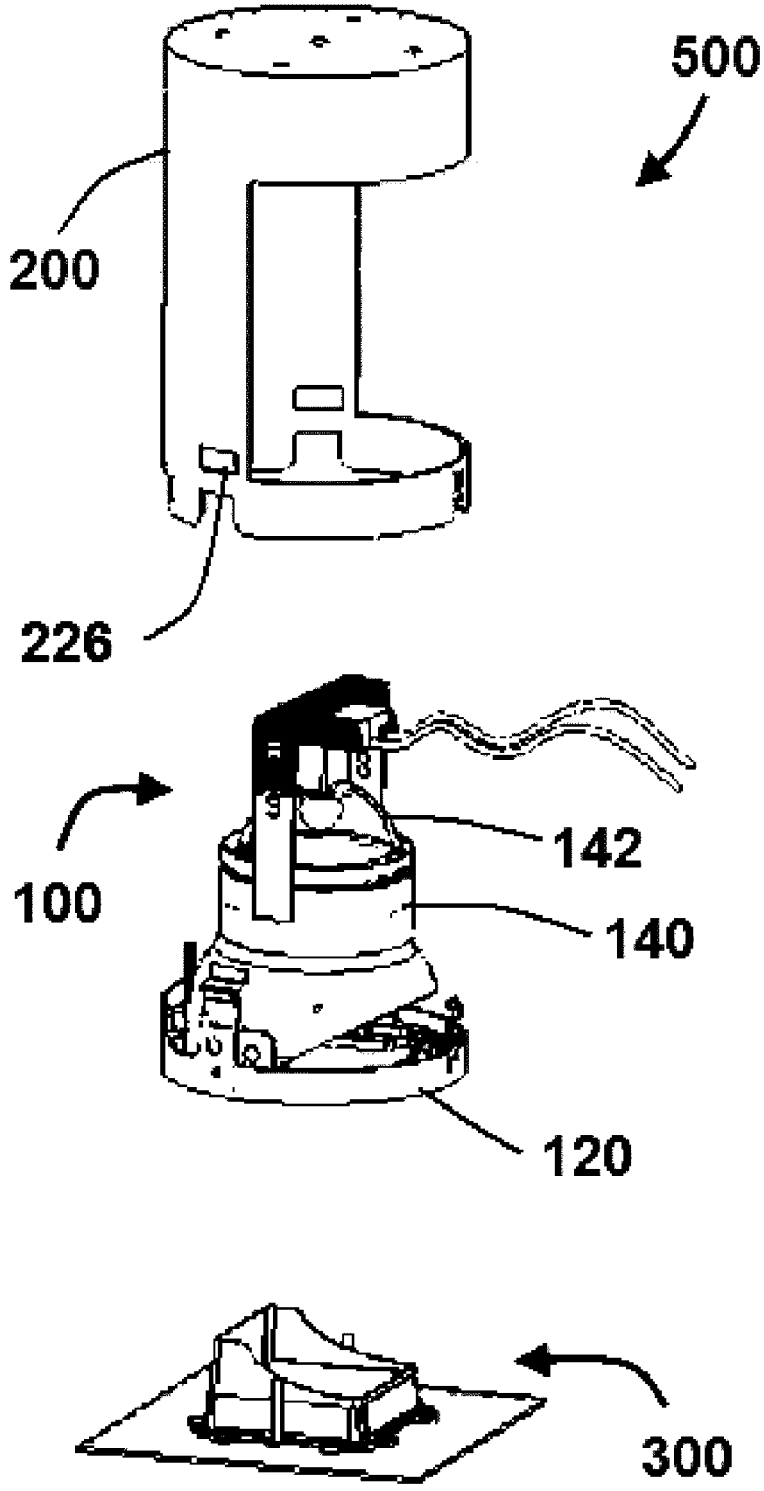
FIG. 1 is an exploded view of an adjustable light fixture, according to an exemplary embodiment of the present disclosure.
Figure 2:
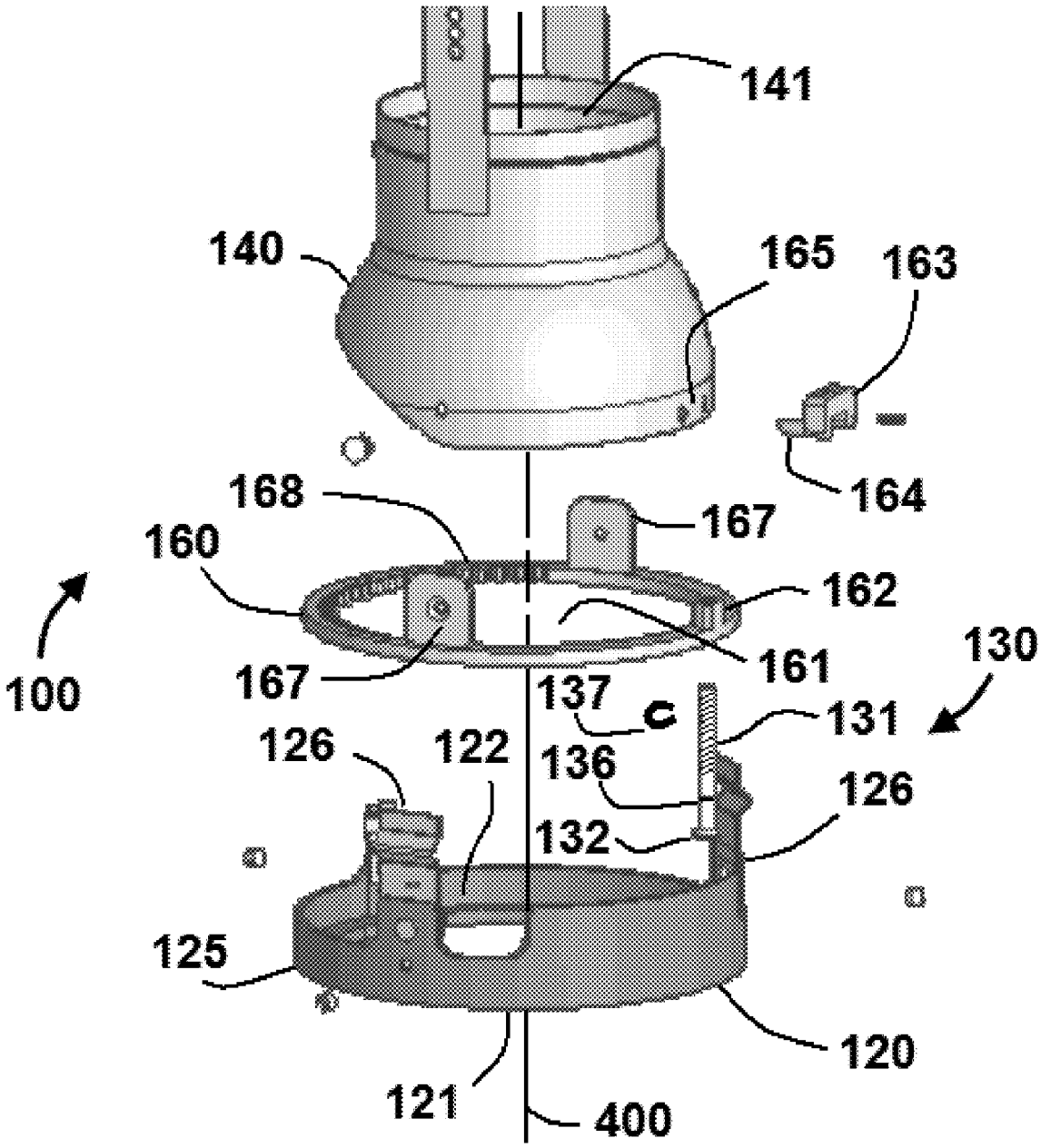
FIG. 2 is an exploded view of a housing assembly of the embodiment of FIG. 1.
Figure 3:
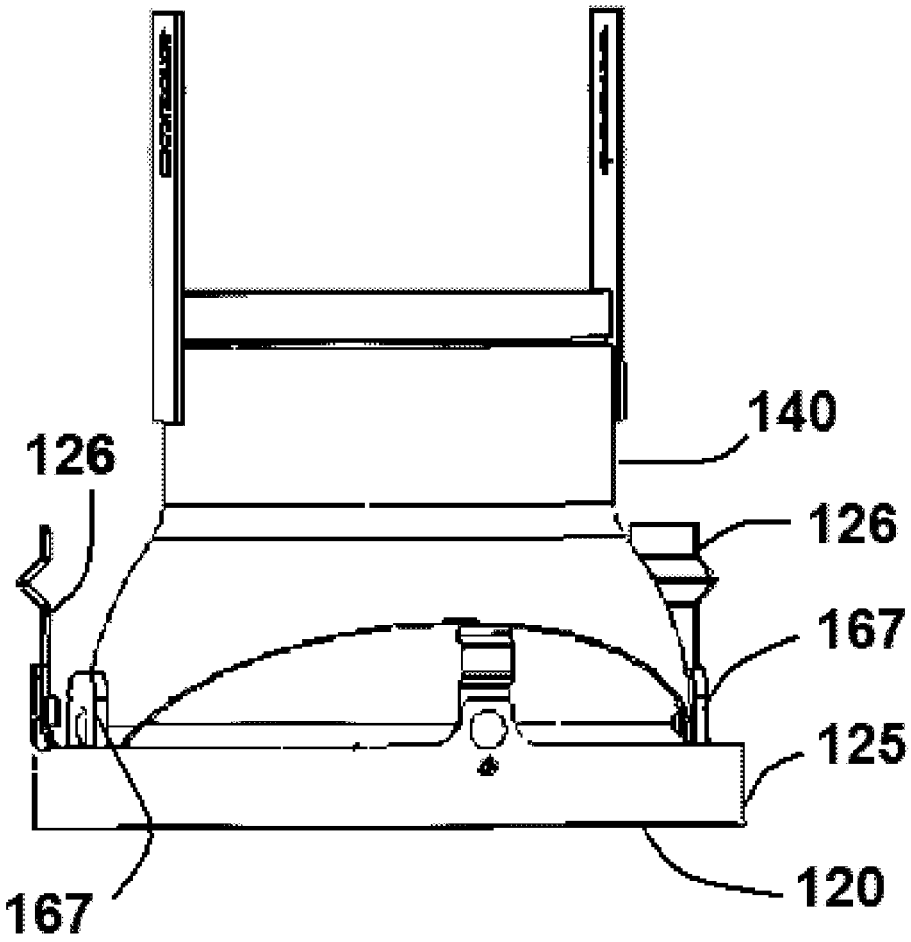
FIG. 3 is a side view of the housing assembly of FIG. 2 in an assembled configuration.

Referring initially to FIG. 1, an adjustable light fixture 500 comprises a housing assembly 100, a mounting can 200, and a trim plate 300. As shown in the exploded view of FIG. 2, housing assembly 100 comprises an outer housing 140 with a central opening 141, as well as a stationary assembly 120 with a central opening 121. Disposed between outer housing 140 and stationary assembly 120 is a rotating ring 160 with a central opening 161. Rotating ring 160 also comprises a pair of pivot members 167 that are coupled to outer housing 140. Stationary assembly 120 comprises a peripheral wall 125 with a pair of projections 126 that engage openings 226 in can 400 (visible in FIG. 1). FIG. 3 illustrates a side view of housing assembly 100 in an assembled configuration, while FIGS. 4 and 5 depict end views of housing assembly 100 as viewed from stationary assembly 120.

As explained in more detail below, housing assembly 100 comprises a first adjustment mechanism 130 configured to tilt outer housing 140 and a second adjustment mechanism 150 configured to rotate outer housing 140. As shown in FIG. 2, first adjustment mechanism 130 comprises a first rotating member 131 with a head portion 132. First rotating member 131 is configured to extend through an opening 162 in rotating ring 160. In certain embodiments, the portion of first rotating member 131 proximal to opening 162 is not threaded, while the portion of first rotating member extending past opening 162 (and proximal to outer housing 140) is threaded. In specific embodiments, first rotating member 131 comprises a groove 136 that can receive a retaining ring 137, which can be installed after first rotating member 131 is installed through opening 162. First rotating member 131 can therefore be held in place by head portion 132 and retaining ring 137, which are disposed on opposite sides of opening 162. In certain embodiments, first rotating member 131 may be configured as a jackscrew. The threaded portion of first rotating member 131 can therefore engage a trunnion 163 that is coupled to outer housing 140. In specific embodiments, trunnion 163 is a threaded bushing that comprises projections 164 that engage openings 165 in outer housing 140. It is understood that in other exemplary embodiments, trunnion 163 may be coupled to outer housing 140 in other suitable manners, or may even be integral with outer housing 140.

Figure 4:
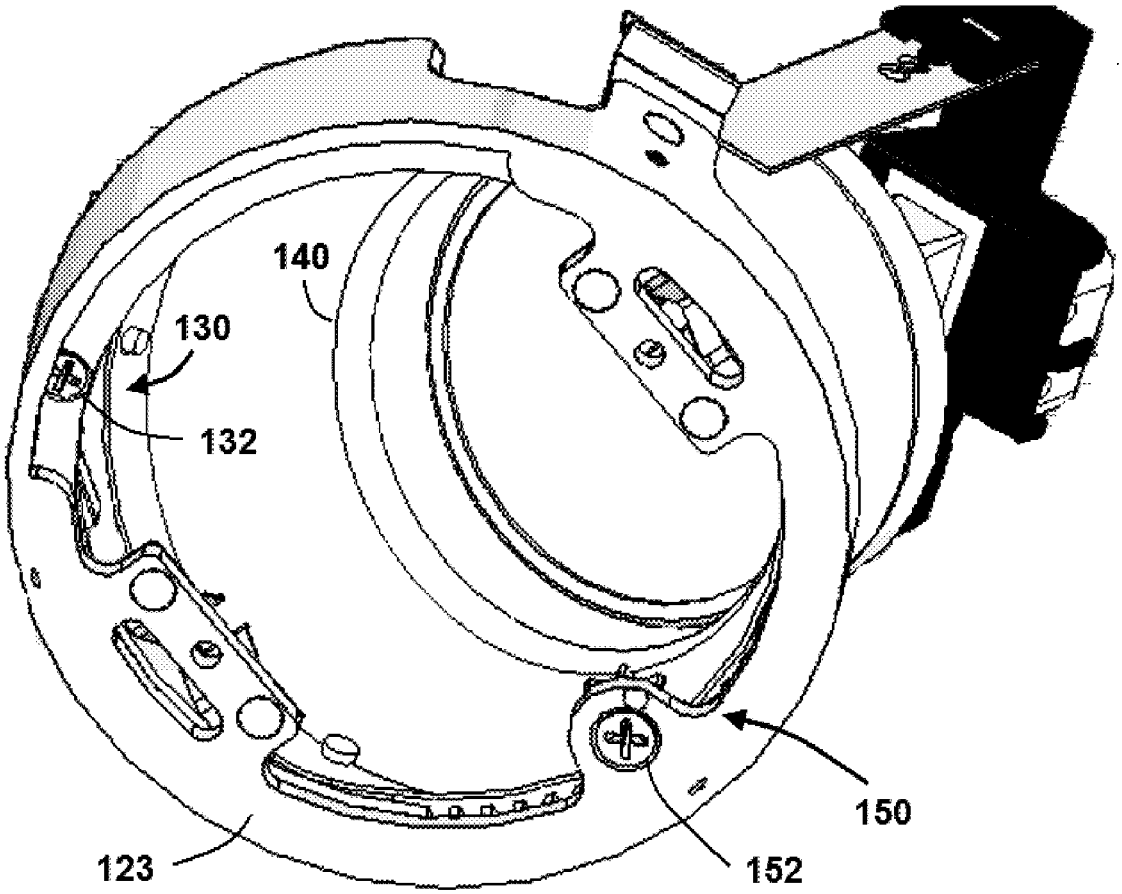
FIG. 4 is an end perspective view of the housing assembly of FIG. 3 at a first rotation position.
Figure 5:
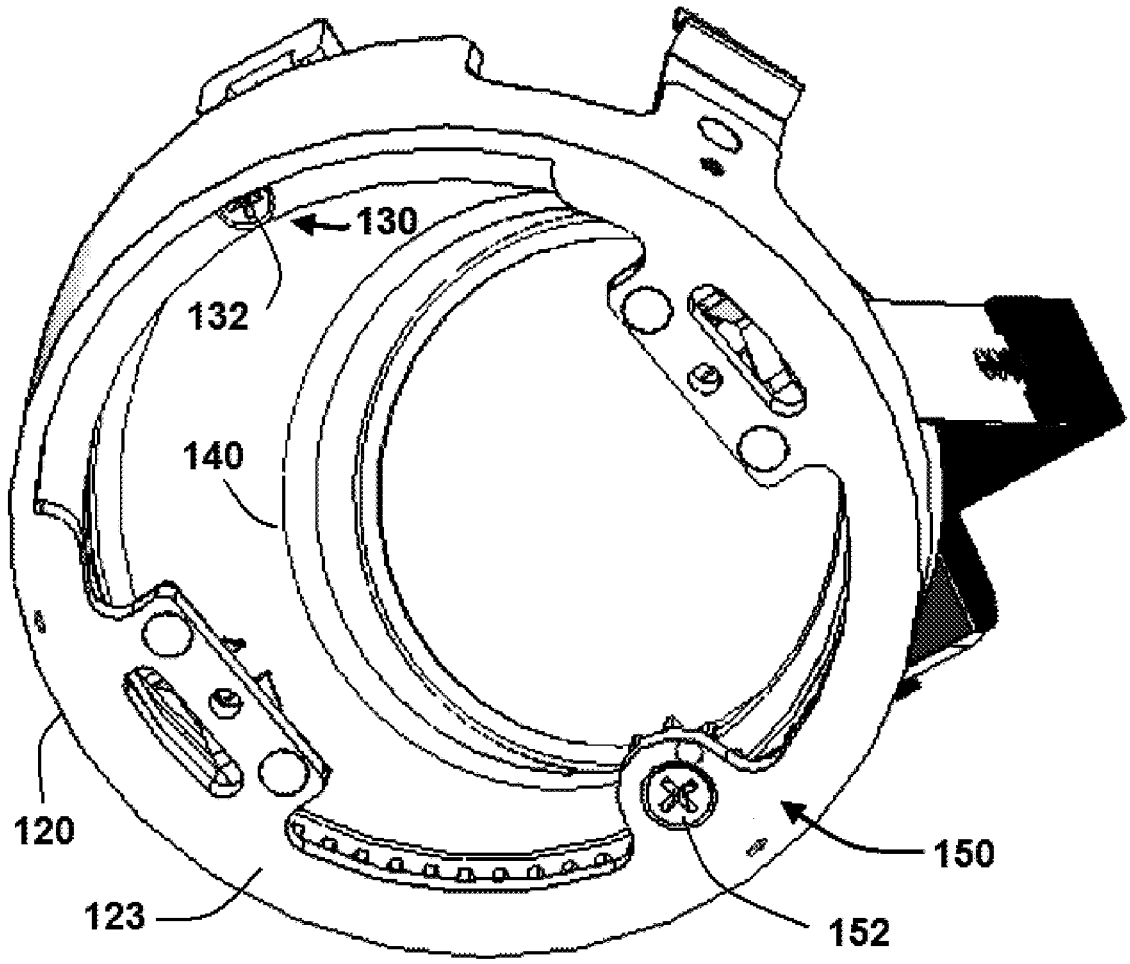
FIG. 5 is an end perspective view of the housing assembly of FIG. 3 at a second rotation position.
Figure 6:
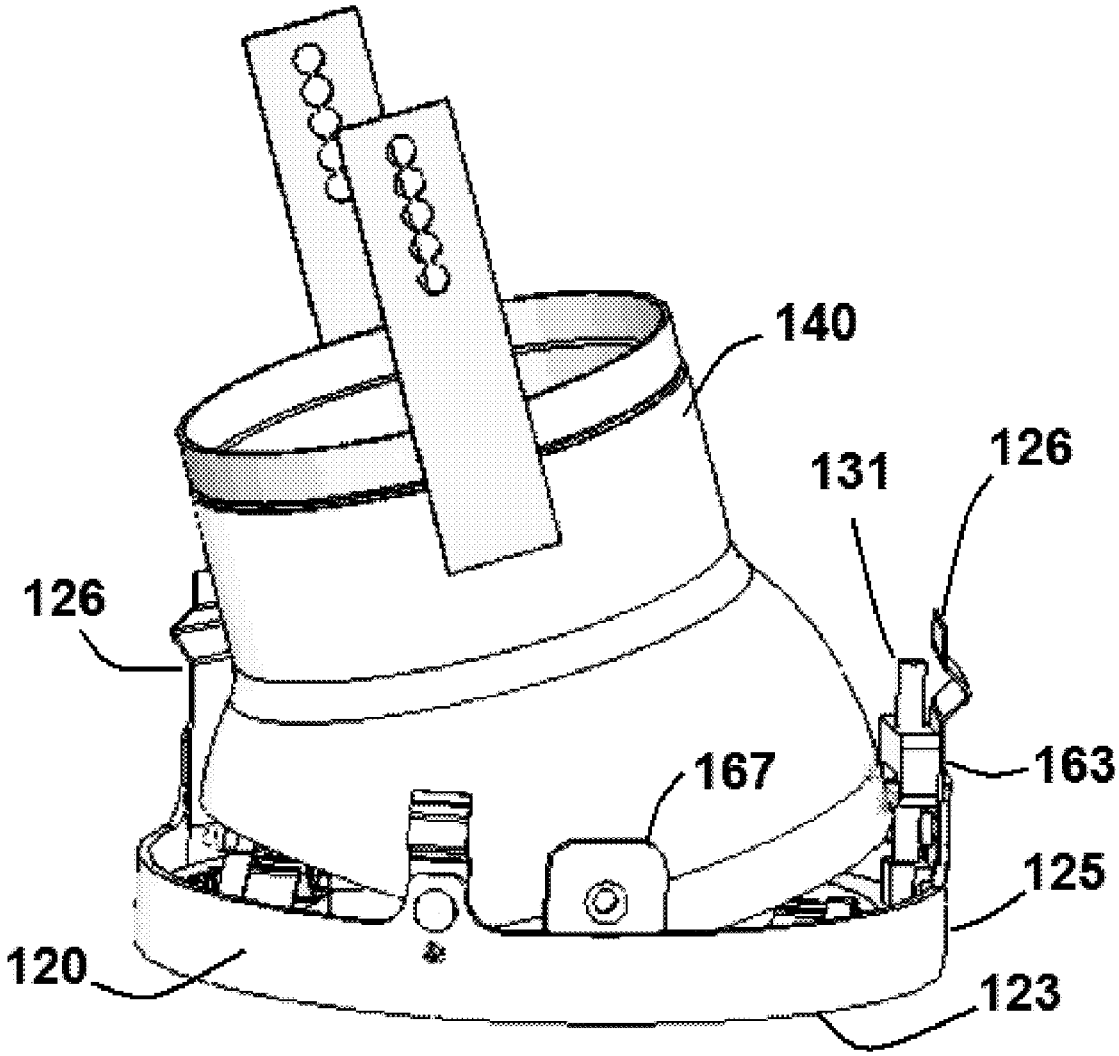
FIG. 6 is a side view of the housing assembly of FIG. 3 in a first tilted position.
Figure 7:
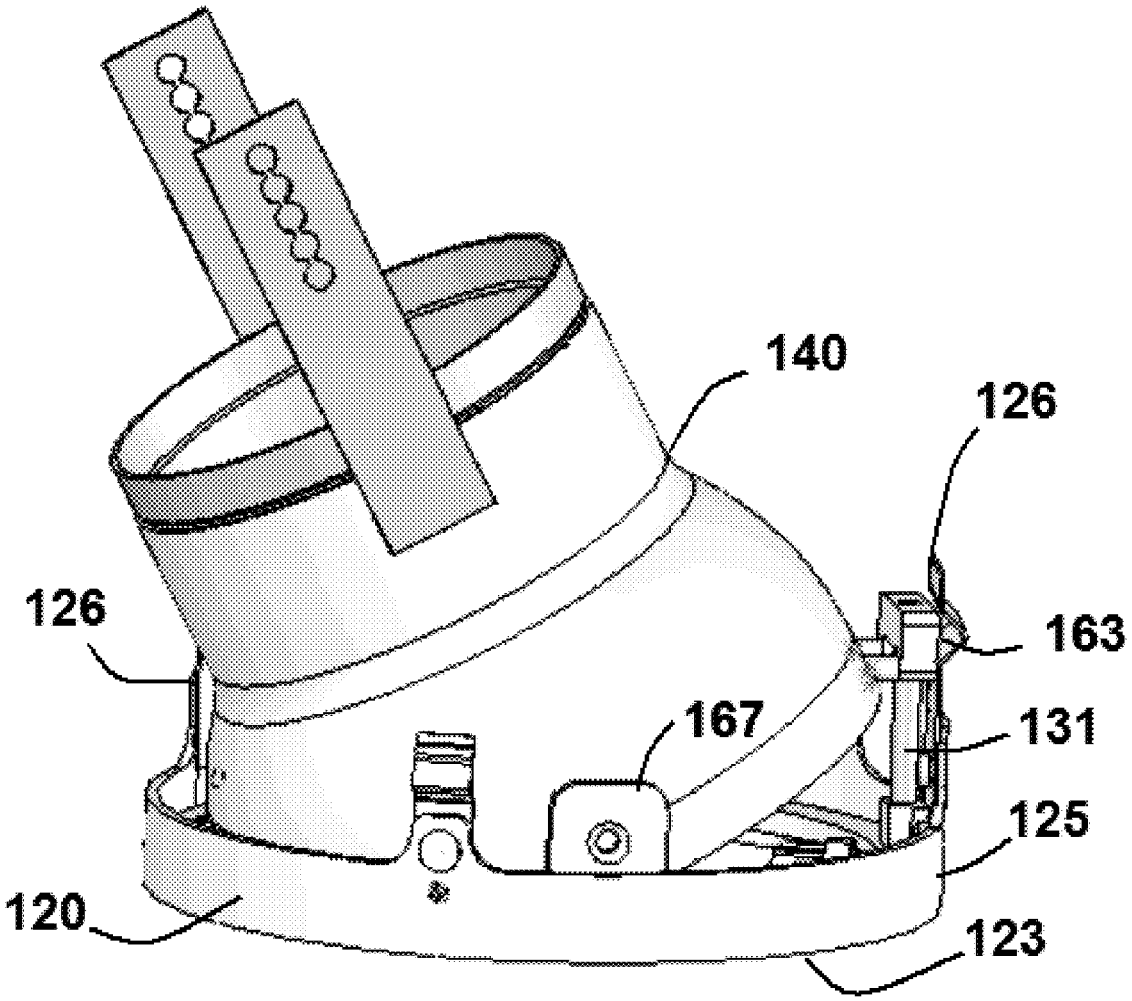
FIG. 7 is a side view of the housing assembly of FIG. 3 in a second tilted position.

As shown in FIGS. 4 and 5, head portion 132 is accessible from the end of housing assembly 100 that comprises stationary assembly 120. Referring now to FIGS. 6 and 7, outer housing 140 can be tilted varying amounts by adjusting first adjustment mechanism 130. Specifically, rotating member 131 can be rotated (for example, by engaging a tool with head portion 132). As rotating member 131 rotates, trunnion 163 is moved axially along rotating member 131. However, rotating member 131 does not move axially with respect to rotating ring 160 because the portion of rotating member 131 that engages opening 162 is not threaded. In one exemplary embodiment, as rotating member 131 is rotated clockwise, trunnion 163 is moved away from head portion 132. It is understood that in other exemplary embodiments, trunnion 163 can be moved towards head portion 132 as rotating member 131 is rotated clockwise.

As shown in FIG. 6, rotating member 131 has been rotated a certain amount so that trunnion 163 is approximately half way between head portion 132 and the distal end of rotating member 131. Trunnion 163 is coupled to one side of outer housing 140; therefore, the movement of trunnion 163 causes ouster housing 140 to tilt or pivot about pivot members 167. As shown in FIG. 7, rotating member 131 has been rotated further so that trunnion 163 is at or near the distal end of rotating member 131. In this view, outer housing 140 has been tilted the maximum amount permitted in this embodiment. It is understood that the length of rotating member 131 may be increased or decreased to adjust the maximum amount of tilt allowed for outer housing 140. In addition, a mechanical stop can be incorporated to restrict the movement of trunnion 163 and limit the amount that outer housing 140 can be titled.

In certain embodiments, adjustment mechanism 130 is configured so that housing 140 can be tilted in either direction from vertical. In such embodiments, for example, when housing 140 is in a completely vertical position (such that a central axis of outer housing 140 is parallel with axis 400 shown in FIG. 2), rotating member 131 can be rotated in one direction to cause outer housing 140 to tilt a first direction. In addition, with outer housing 140 in a completely vertical position, rotating member 131 can be rotated a second direction to cause outer housing 140 to tilt in a direction opposite of the first direction.

Figure 8:
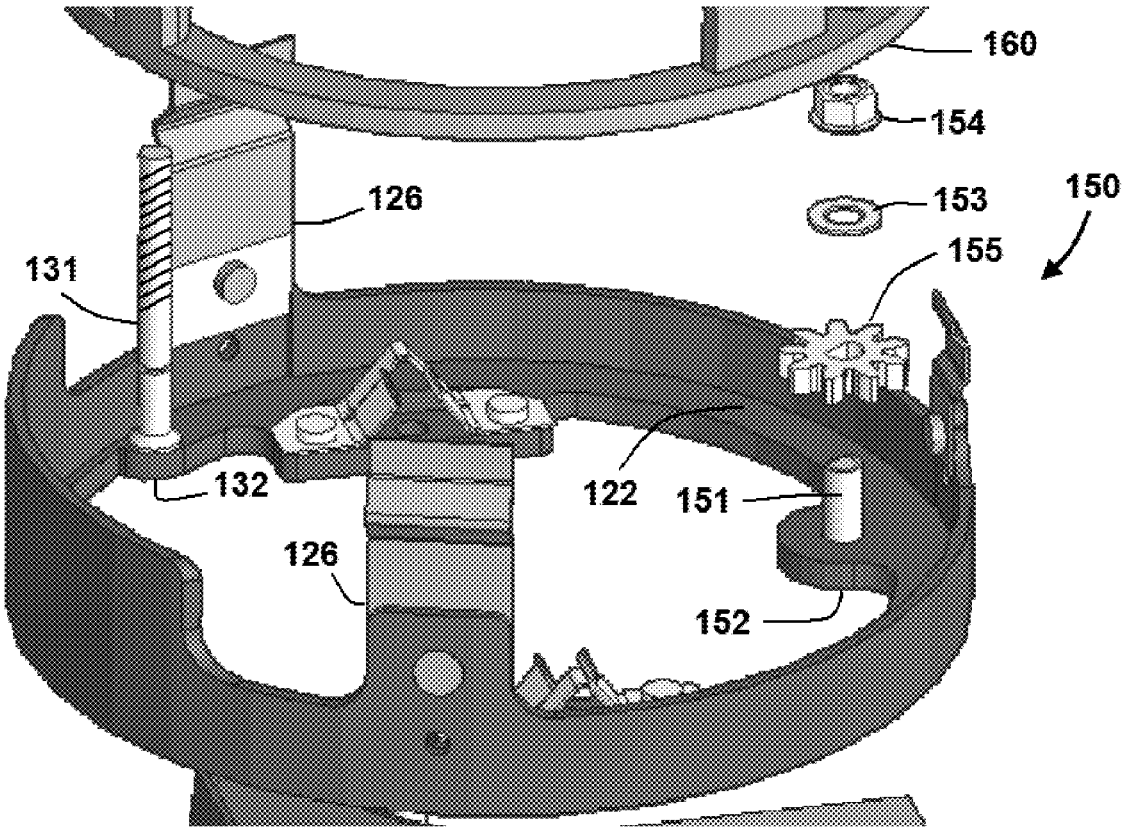
FIG. 8 is a detailed view of the stationary assembly of FIG. 3.
Figure 9:
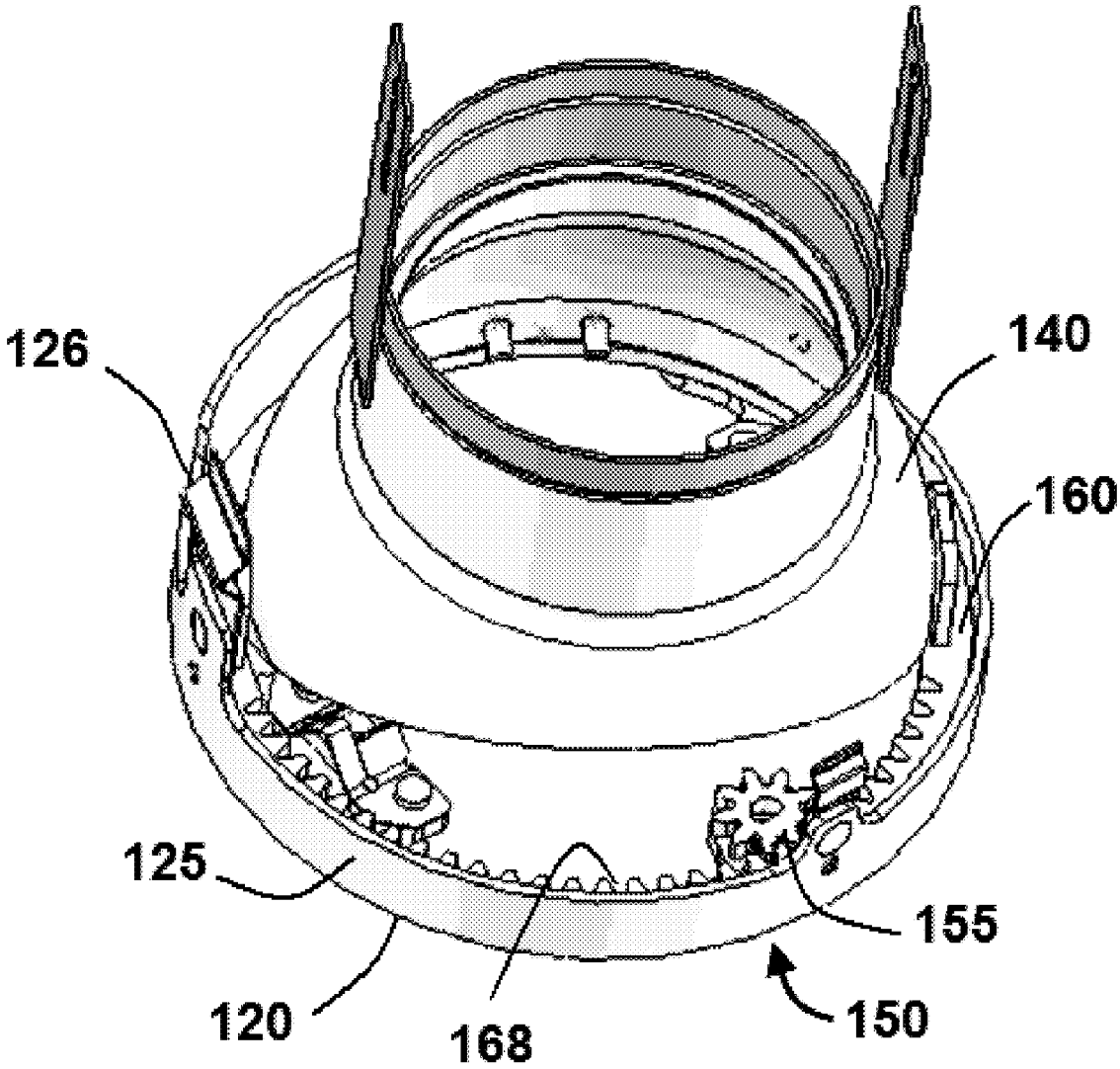
FIG. 9 is a top perspective view of the housing assembly of FIG. 3.
Figure 10:
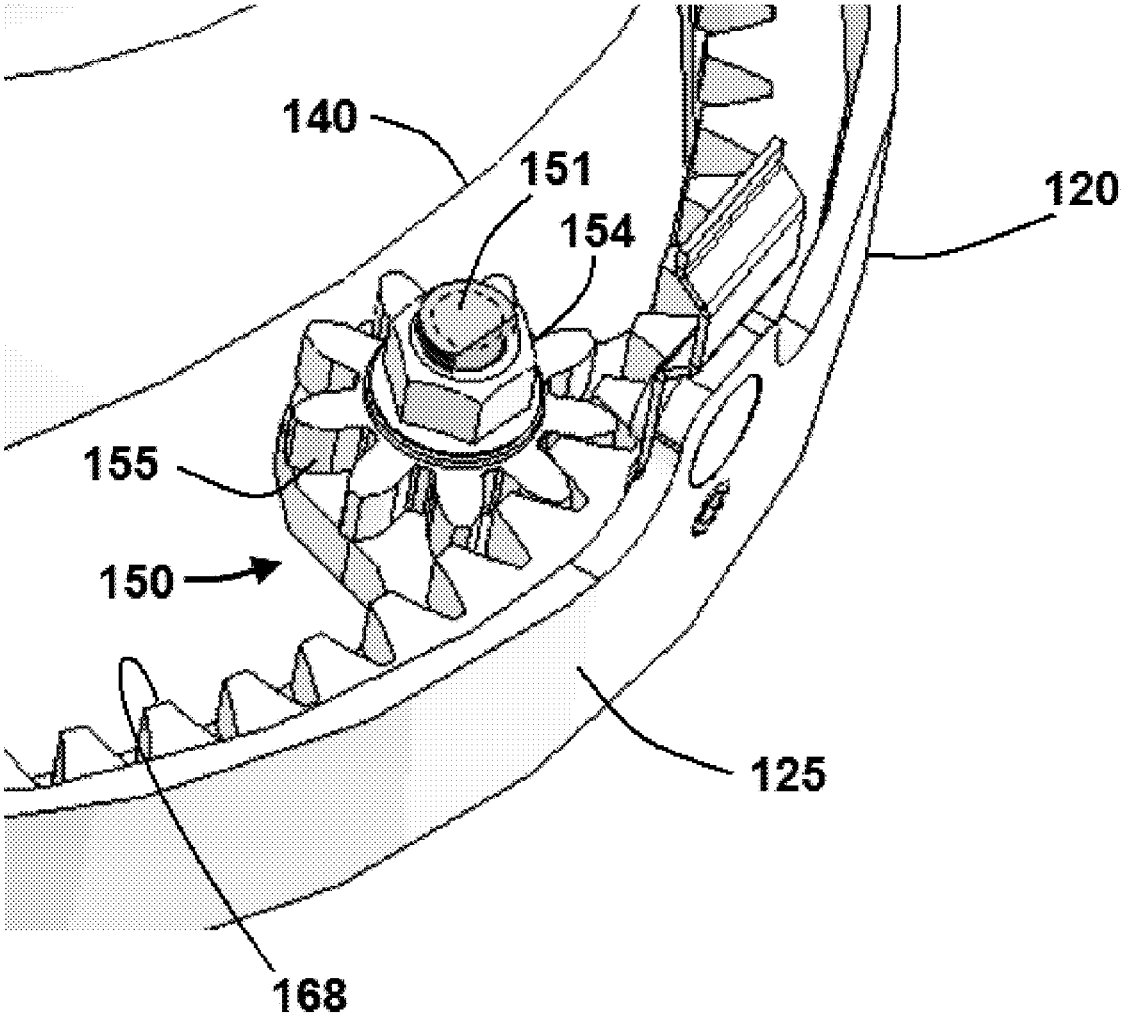
FIG. 10 is a detailed view of an adjustment mechanism of the housing assembly of FIG. 3.

Referring now to FIGS. 8-10, a second adjustment mechanism 150 (configured as a gear assembly in this embodiment) comprises a second rotating member 151, a gear member 155, a washer 153, and a retaining member 154. In the embodiment shown, retaining member 154 is a nut that threads onto a threaded portion of second rotating member 151. It is understood that in other embodiments, retaining member 154 may comprise any suitable mechanism for retaining gear member 155 onto second retaining member 151 (including, for example, a cotter pin).

As shown in FIG. 8, second rotating member 151 comprises a non-circular cross-section, which in this particular embodiment is a partial circle with a flat side. Also visible in FIG. 8, gear member 155 comprises an opening with a similar shape as the cross-section of second rotating member 151. Therefore, as second rotating member 151 rotates, gear member 155 will also rotate. In other embodiments, gear member 155 may be coupled to second rotating member 151 in any suitable manner that allows second rotating member 151 to impart rotation to gear member 1555 (including for example, a pin or a friction fit).

When housing assembly 100 is assembled, rotating ring 160 is seated on a seating area 122 of stationary assembly 120. With this configuration, gear member 155 can engage a gear segment 168 (as shown in FIGS. 9 and 10) on rotating ring 160. As gear member 155 rotates (about the axis of second rotating member 151), rotating ring 160 will also rotate (about a central axis of rotating ring 160, such as axis 400 shown in FIG. 2). Rotating ring 160 is coupled to outer housing 140 at pivot members 167. Therefore, as rotating ring 160 rotates, so will outer housing 140.

As shown in the end views of FIGS. 4 and 5, second rotating member 151 comprises a head portion 152 that is accessible from the end of housing assembly 100 that includes stationary assembly 120. In the embodiment shown, head portion 152 (and consequently, second rotating member 151 and gear member 155) can be rotated by inserting a screw driver into head portion 152 and rotating the tool. It is understood that head portions 152 and 132 may be configured to accept other devices to provide rotation (including for example, allen wrenches, ratchets, etc.). As shown in FIGS. 4 and 5, rotation of head portion 152 causes rotating ring 160 to rotate as well. In FIG. 5, for example, head portion 132 is visible approximately 180 degrees from head portion 152. However, as head portion 152 is rotated, ring 160, and with it head portion 132, are rotated to a different position. In the position shown in FIG. 4, ring 160 has been rotated so that head portion 132 has been moved counter-clockwise so that it is closer to pivot member 167.

In the above-described manner, adjustable light fixture 500 comprises a housing assembly 100 that allows outer housing 140 to be both tilted and rotated by adjusting head portions 132 and 152. As shown in the figures and explained in the description, head portions 132 and 152 (of first and second rotating members 131 and 151) are accessible from the end of housing assembly 100 comprising stationary assembly 120. As shown in FIG. 8, first and second rotating members 131 and 151 are arranged so that they are generally parallel to each other and to axis 400 (shown in FIG. 2) extending through the center of housing assembly 100. In addition, the ends of head portions 132 and 152 lie in planes that are generally parallel with an end surface 123 (shown in FIGS. 4 and 5) of stationary assembly 120. This allows a user to easily access head portions 132 and 152 (and adjust first and second adjustment mechanisms 130 and 150) when housing assembly is installed in mounting can 200.

When a light source 142 (such as a light bulb, shown in FIG. 1) is coupled to outer housing 140, the light provided by adjustable light fixture 500 can be directed in a preferred direction by rotating and/or tilting outer housing 140. With head portions 132 and 152 accessible while housing assembly 100 is installed in mounting can 200, a user can precisely aim the light after adjustable light fixture 500 has been installed. Head portions 132 and 152 remain in the same plane parallel to end surface 123 during the full range of adjustment. Therefore, a user does not have to reach up into housing assembly 100 in order to adjust the position of light source 142 and outer housing 140. This feature can allow a user to comfortably adjust the position of light source 142 while it is in operation without having to get close to light source 142 and risk being burned by the surface of light source 142.

In certain embodiments, adjustable light fixture 500 is configured to allow light source 142 and outer housing 140 to be tilted from 0 to 60 degrees, or any amount in between. For example, an axis passing through the center of outer housing 140 may be positioned at an angle of 0-60 degrees to axis 400 shown in FIG. 2. In other embodiments, outer housing may be titled from 0 to 90 degrees. In addition, in certain embodiments, light source 142 and outer housing 140 may be rotating from 0 to 120 degrees, or any amount in between these values. In other embodiments, outer housing may be rotated from 0 to 360 degrees. In such embodiments, the rotating ring may comprise a gear segment that extends completely around the rotating ring.

Figure 11:
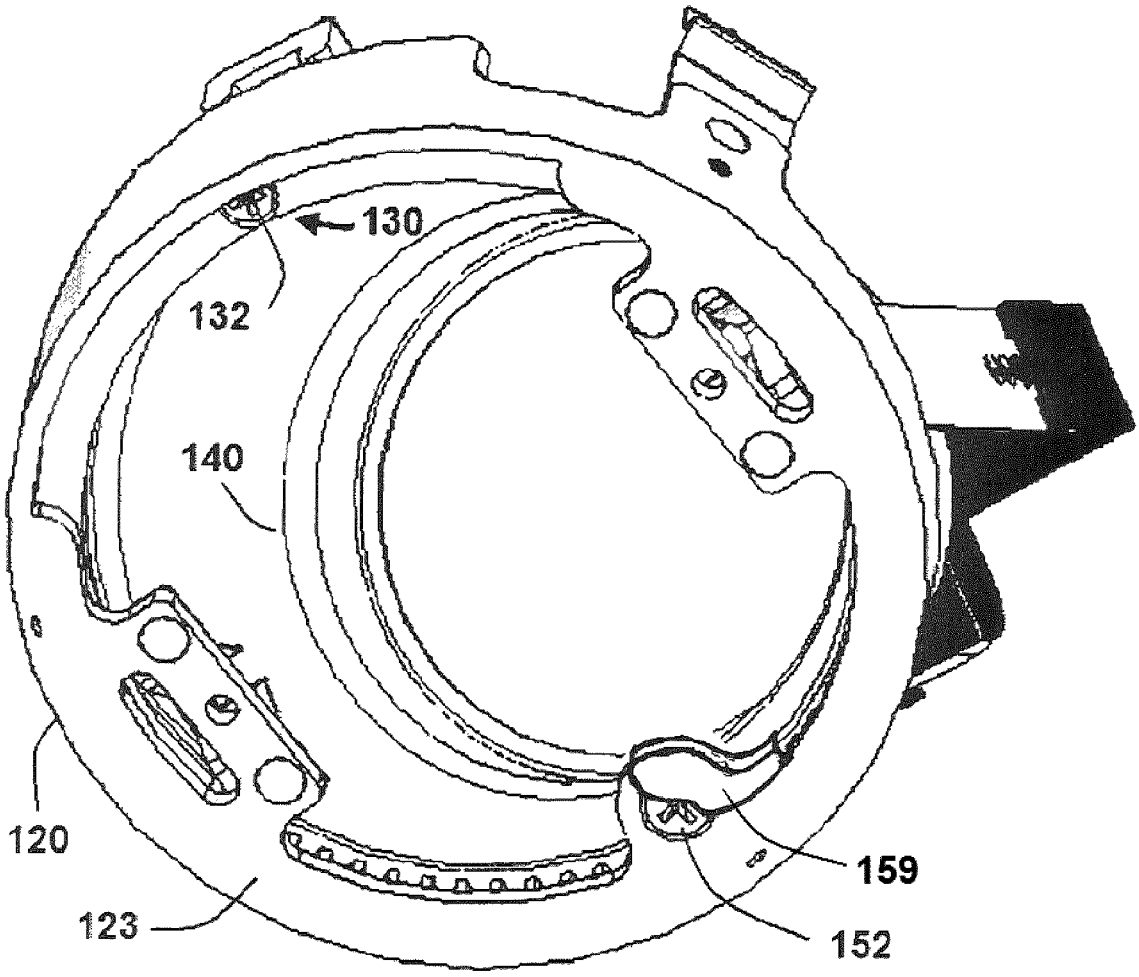
FIG. 11 is an end perspective view of alternate embodiment of a housing assembly with a locking mechanism.
Figure 12:
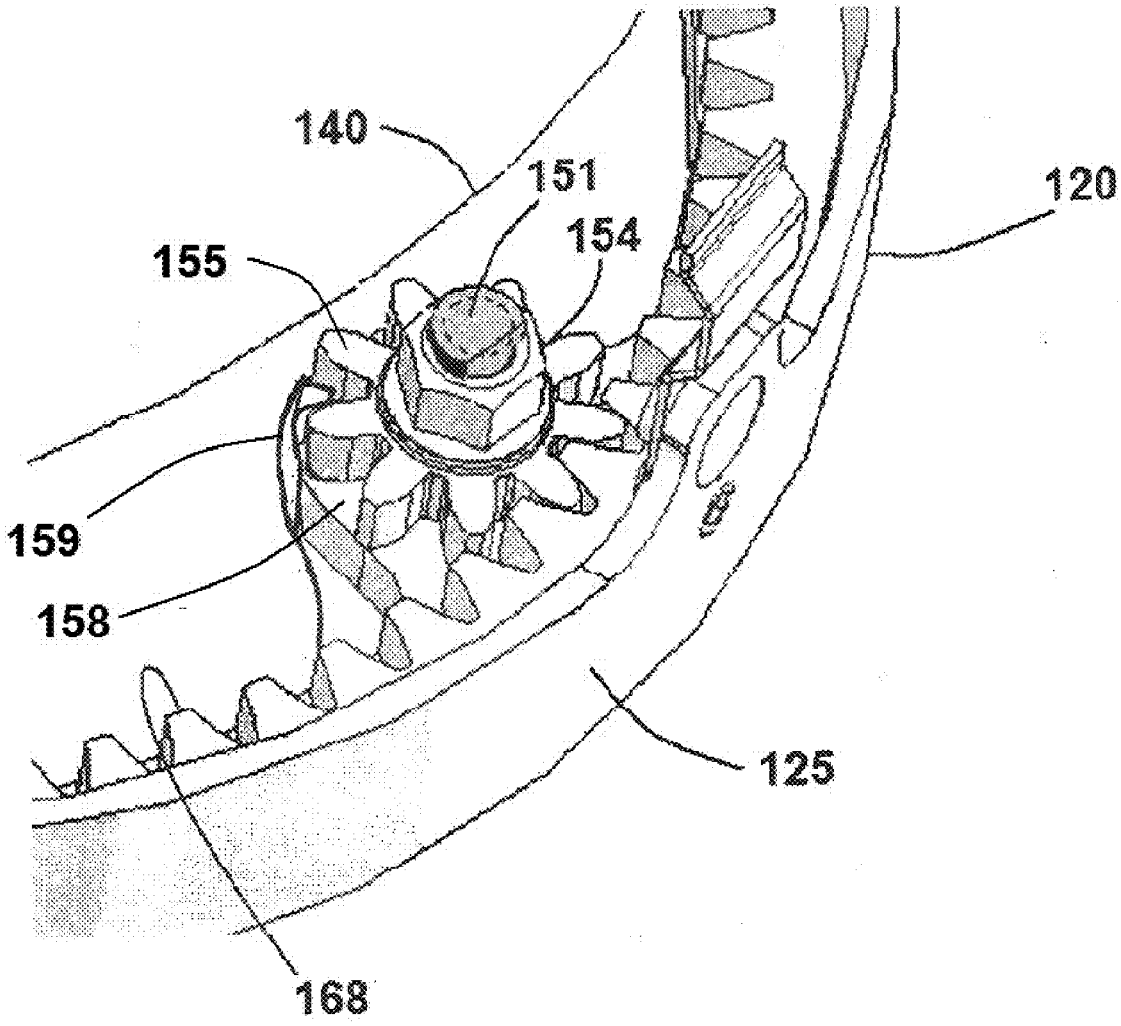
FIG. 12 is a detailed view of an adjustment mechanism of the housing assembly of FIG. 11.

Referring now to FIGS. 11 and 12, an alternative embodiment is shown to include a locking mechanism 159 for second adjustment mechanism 150 (which is configured to rotate outer housing 140). In the embodiment shown, locking mechanism 159 comprises a spring-loaded pawl that is normally biased to engage gear member 155 and prevent gear member 155 from rotating. Locking mechanism 159 can prevent outer housing 140 from being unintentionally rotated (such as, for example, when a light source is being replaced). When it is desired to change the rotation of outer housing 140, a user can disengage locking mechanism 159 from gear member 155 by overcoming the biasing force that causes locking mechanism 159 to engage gear member 155. Movement of locking mechanism 155 also provides access to head portion 152 and allows a user to rotate second rotating member 151 and adjust second adjustment mechanism 150.

In other embodiments, a locking mechanism for second adjustment mechanism 150 may comprise other structures. For example, gear member 155 may comprise serrations on the bottom surface that engage corresponding serrations on support surface 158 of stationary assembly 120. When the serrations are engaged, gear member 155 cannot be rotated to allow outer housing 140 to be rotated. However, a user can disengage the serrations by pushing up on head portion 152, and lifting gear member 155 (which in certain embodiments can be axially fixed to second rotating member 151). When gear member 155 is not engaged with support surface 158, second rotating member 151 can be rotated to adjust the rotational position of outer housing 140.

In specific embodiments such as those shown and described in FIGS. 1-10, the first adjustment mechanism 130 is inherently self-locking so that external tilting forces exerted on outer housing 140 will not cause first adjustment mechanism 130 to change position (and specifically will not cause first rotating member 131 to rotate). In such embodiments, there is no need for an external locking mechanism to prevent unintended manipulation of the tilt position of outer housing 140 (for example, when a user changes a light source). It is understood that in other embodiments, however, first adjustment mechanism 130 may comprise an external locking mechanism similar to that described for second adjustment mechanism 150.

When a light source 142 (such as a light bulb, shown in FIG. 1) has been precisely aimed by a user as previously described, there becomes a time when it is necessary to replace the light source when it no longer operates (for example, when a light bulb burns out). It may therefore be necessary to remove trim plate 300 from housing assembly 100, and/or housing assembly from mounting can 200. Such actions can exert forces on outer housing 140, which could alter the desired location of outer housing 140 and aim of light source 142.

In the embodiments described herein, the re-insertion of light source 142, housing assembly 100, and/or trim plate 300 can be accomplished without disturbing the preferred direction of rotation and tilt for outer housing 140. As explained above, locking mechanism 159 can prevent unintended rotation of housing 140 with respect to stationary assembly 120. Stationary assembly 120 also comprises a peripheral wall 125 with a pair of projections 126 that engage openings 226 in can 400. In this manner, stationary assembly 120 is indexed to mounting can 200, so that removal and replacement of stationary assembly 120 will not disturb the intended rotational orientation of outer housing 140. Furthermore, mounting can 200 can be indexed to a light fixture housing (not shown), via openings in the top of mounting can 200 that engage pins in the light fixture housing. As a result, stationary assembly 120 and/or mounting can 200 can be removed and replaced without disturbing the intended rotational orientation. Furthermore, the geometry of the tilting adjustment mechanism allows it to remain in the desired location when stationary assembly 120 and/or mounting can 200 are removed.

These features allows a user, and premises owner, to ensure that the position of light source 142 will not be varied during routine light source maintenance. This can be a cost savings feature for lighting applications in for example, retail stores, hotels, restaurants, commercial offices, museums and residences where lighting of retail merchandise, interior furnishings, task functions, and artwork require assurance of dedicated illuminated orientation without having a professional lighting consultant or equivalent party re-aim lighting after routine light source maintenance.

Referring now to FIGS. 13-23 another embodiment of an adjustable light fixture 1500 comprises a housing assembly 1100 and a trim plate 1300. Adjustable light fixture 1500 may be installed in a recessed mounting receptacle (e.g., a mounting can, a collar, a housing, or any type of bracketry for a tilting and/or rotating mechanism, not shown in the figures). In the embodiment shown in FIGS. 13-23, components that are similar or equivalent to components in the previously described embodiment are given similar reference numbers. For example, a trunnion in adjustable light fixture 1500 is given a reference number of "1163", while the trunnion of adjustable light fixture 500 is given reference number "163". For the sake of brevity, components and features of adjustable light fixture 1500 that are redundant to adjustable light fixture 500 will not be explained in detail. In addition, not all components will be labeled in all figures for purposes of clarity.

Figure 13:
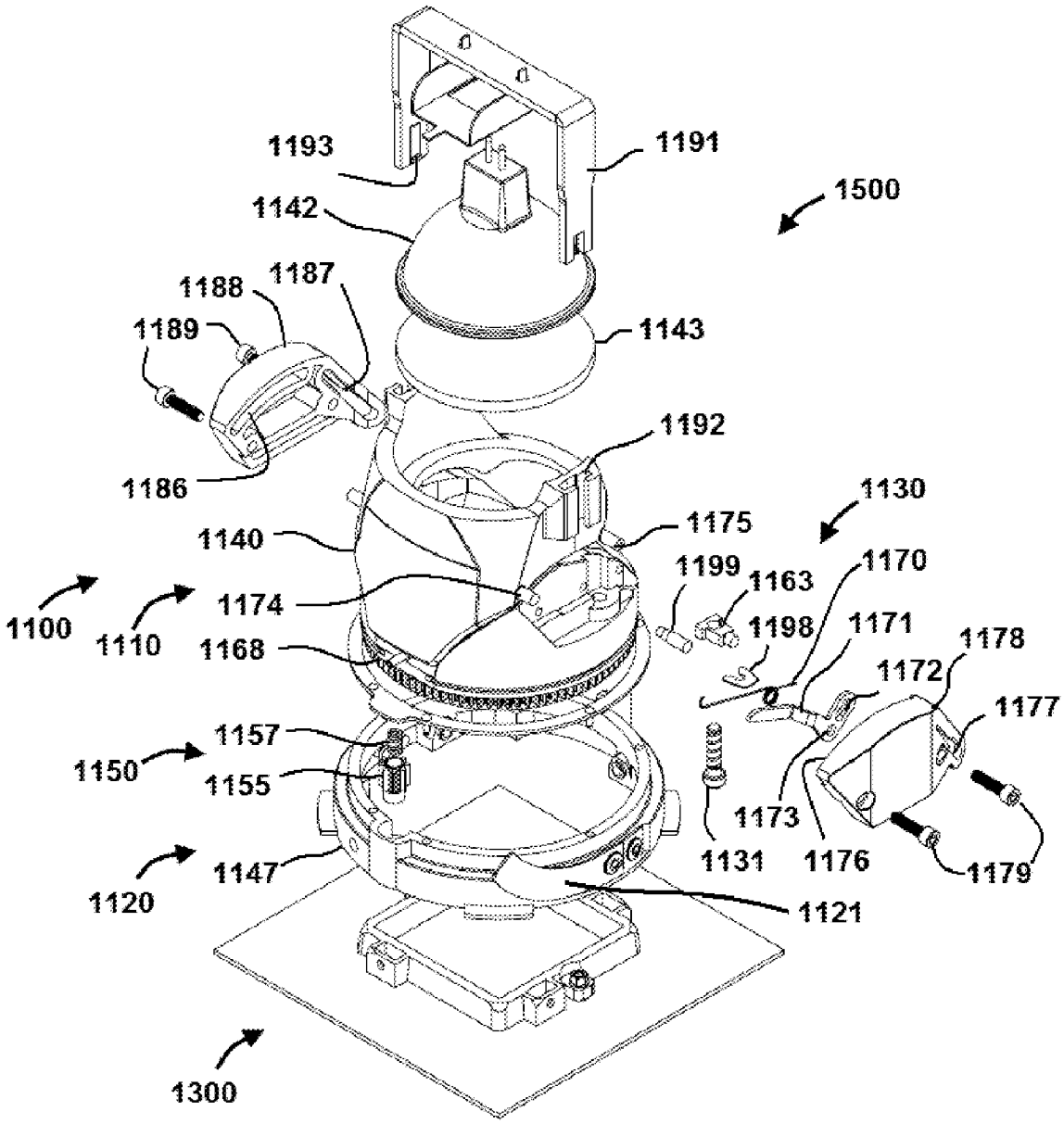
FIG. 13 is an exploded view of an adjustable light fixture, according to an exemplary embodiment of the present disclosure.

Referring initially to FIG. 13, an exploded view of an adjustable light fixture 1500 comprises a housing assembly 1100 and a trim plate 1300. Adjustable light fixture 1500 operates in a similar manner to that of adjustable light fixture 500. For example, adjustable light fixture 1500 comprises a first adjustment mechanism 1130 configured to adjust the tilting of outer housing 1140 and a second adjustment mechanism configured to adjust the rotation of outer housing 1140. Adjustable fixture 1500 also provides additional benefits and advantages in operation not found on adjustable light fixture 500. Housing assembly 1100 comprises an upper portion 1110 (including, for example, outer housing 1140, gear segment 1168, alignment brackets 1178 and 1188) that is configured to rotate or tilt when first adjustment mechanism 1130 or second adjustment mechanism 1150 are manipulated. Housing assembly 1100 comprises a lower portion 1120 (including, for example, base ring 1147 and a biasing member 1121) that is not configured to rotate or tilt when first adjustment mechanism 1130 or second adjustment mechanism 1150 are manipulated For example, first adjustment mechanism 1130 comprises a biasing member 1170 configured to bias outer housing 1140 to a specific position. Adjustment mechanism 1130 works in generally the same manner as adjustment mechanism 130. However, trunnion 1163 does not engage a pivot member on a rotating ring. Instead, trunnion 1163 engages a slot 1172 in a lever arm 1171. As trunnion 1163 is raised and lowered (via rotation of first rotating member 1131), lever arm 1171 is pivoted about pivot pin 1199, which is inserted through pivot point 1173 and a loop in biasing member 1170. First rotating member 1131 is retained in place by a retainer 1198, which engages a non-threaded portion of first rotating member 1131.

Figure 14:
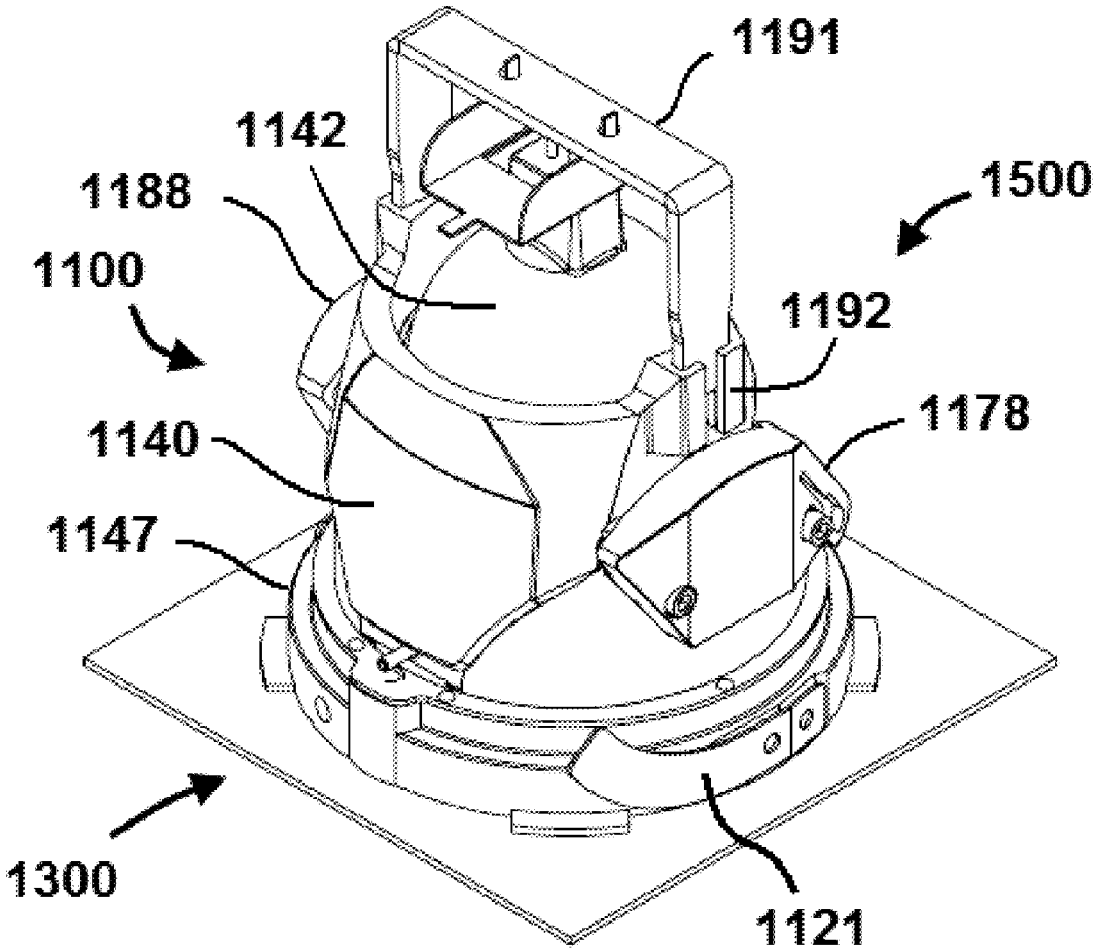
FIG. 14 is a perspective view of the embodiment of FIG. 13.
Figure 15:
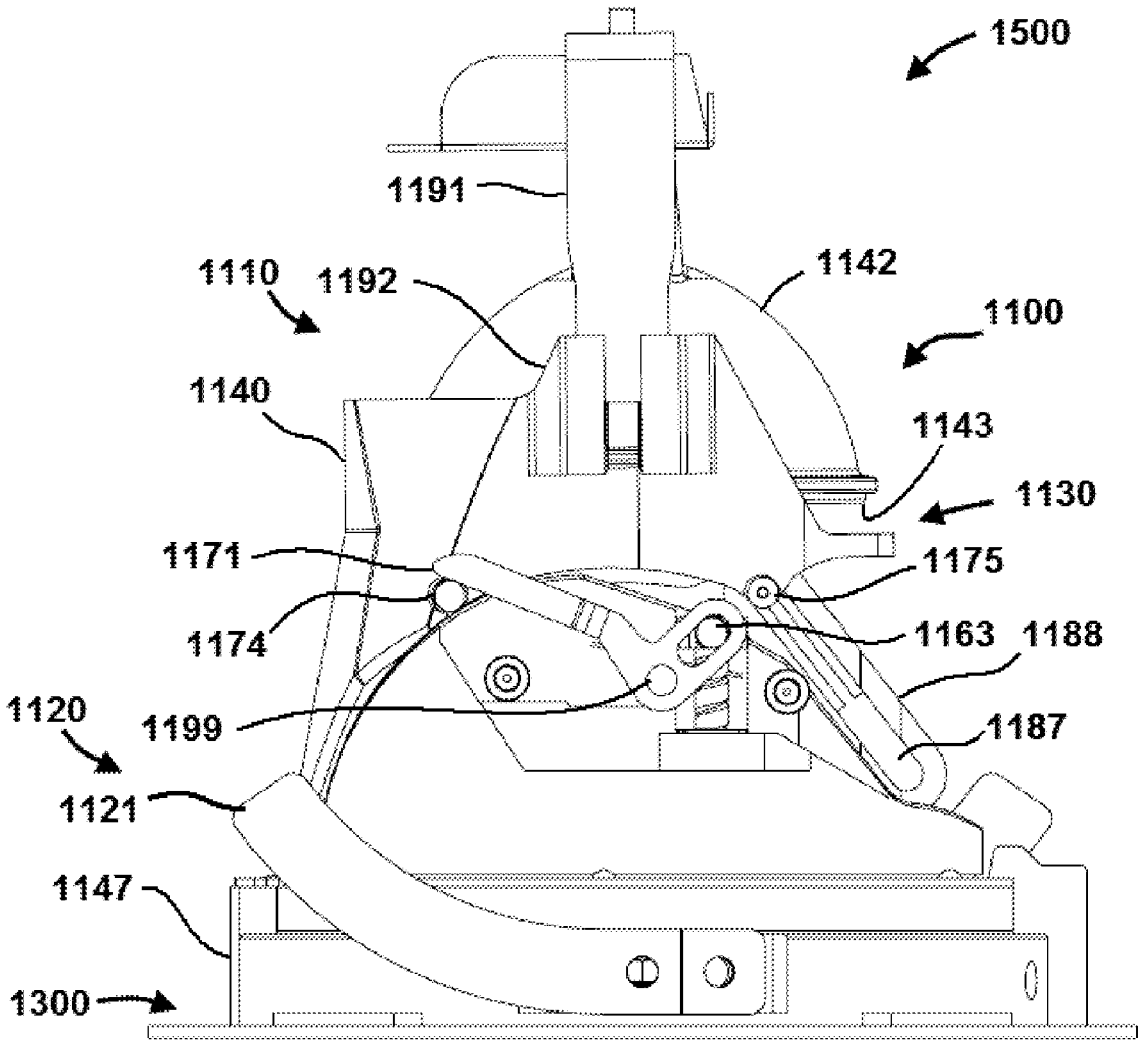
FIG. 15 is a side view of the embodiment of FIG. 13.
Figure 16:
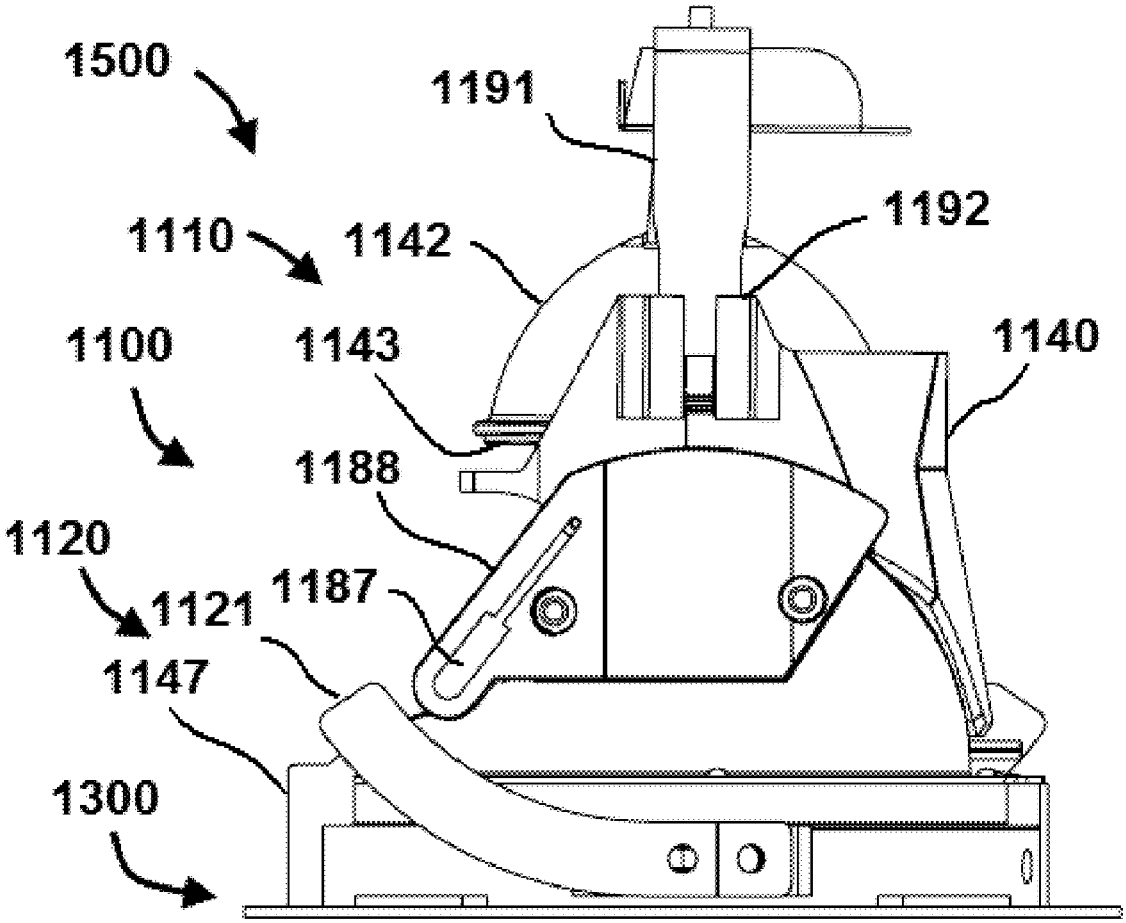
FIG. 16 is a side view of the embodiment of FIG. 13.

The pivoting of lever arm 1171 provides for the tilting of outer housing 1140 in the following manner. Outer housing 1140 comprises a first engagement pin 1174 that is biased (via biasing member 1170) towards lever arm 1171. First engagement pin 1174 also engages a first slot 1176 in a first alignment bracket 1177. Although not visible in FIG. 13, first slot 1176 is equivalent to a first slot 1186 (which is visible in FIG. 13) in a second alignment bracket 1188 that is on the opposite side of outer housing 1140 via retaining members 1189. Outer housing 1140 also comprises a second engagement pin 1175 that engages a second slot 1177 in an alignment bracket 1178. When assembled, first alignment bracket 1178 is coupled to outer housing 1140 via a pair of retaining members 1179. FIG. 14 provides a perspective view of adjustable light fixture 1500 in an assembled condition, while FIG. 15 provides a side view of adjustable light fixture 1500 partially assembled but without alignment bracket 1178 installed. Without alignment bracket 1178 installed, the components of adjustment mechanism 1130.

As trunnion 1163 is lowered and lever arm 1171 is pivoted clockwise (as viewed from alignment bracket 1177 in FIG. 13), biasing member 1170 biases first engagement pin 1174 towards lever arm 1171 so that first engagement pin 1174 travels within slot 1176. This will cause outer housing 1140 to pivot clockwise. First and second engagement pins 1174 and 1175 remain engaged with first and second slots 1176 and 1177 as outer housing 1140 pivots clockwise. Trunnion 1163 can be lowered to a point at which first or second engagement pins 1174, 1175 reach the end of first or second slots 1176 and 1177, respectively. The maximum degree that outer housing 1140 can be tilted will depend on the dimensions and geometry of the components of adjustable light fixture 1500, including for example, the lengths of first slot 1176 and second slot 1177.

After outer housing 1140 has been tilted in the above-described manner, it can be returned to the vertical position shown in FIGS. 13-20 by rotating first adjustment member 1131 and raising trunnion 1163. When trunnion 1163 is raised and lever arm 1171 is pivoted counter-clockwise (as viewed from alignment bracket 1177 in FIG. 13), lever arm 1171 exerts a force on first engagement pin 1174 sufficient to overcome the force exerted by biasing member 1170. This will cause outer housing 1140 to pivot counter-clockwise as well. First and second engagement pins 1174 and 1175 remain engaged with first and second slots 1176 and 1177 as outer housing 1140 pivots toward the vertical position.

First adjustment mechanism 1130 provides additional benefits not found on prior tilting mechanisms. For example, first adjustment mechanism 1130 can allow a user to remove housing assembly 1100 from a recessed mounting receptacle, (including for example, a mounting can, a collar, a housing, or any type of bracketry for a tilting and/or rotating mechanism) and maintain the desired degree of tilt for outer housing 1140. For instance, during use it may be desirable to tilt outer housing 1140 to a degree that does not permit it to be pulled straight out of the mounting can without reducing the degree of tilt. First adjustment mechanism 1130 does not require that a user manually reduce the degree of tilt before outer housing 1140 is removed (e.g., by turning first adjustment member 1131). Instead, a user can remove trim plate 1300 and pull housing assembly 1100 out of the recessed mounting receptacle without reducing the degree of tilt of outer housing 1140 (which is coupled to trim plate 1300 via a base ring 1147). This is accomplished by pulling on housing assembly 1100 with sufficient force to overcome the force that biasing member 1170 exerts on first engagement pin 1174. For example, upper bracket 1191 (which engages a pair of slots 1192 on outer housing 1140) may engage the recessed mounting receptacle while housing assembly 1100 is being removed. As the user continues to pull on housing assembly 1100, the recessed mounting receptacle exerts a force on upper bracket 1191 that overcomes the biasing force exerted by biasing member 1170 causes outer housing 1140 to pivot towards a vertical position (e.g. co-linear with the axis of the recessed mounting receptacle). First engagement pin 1174 slides within first slot 1176 and second engagement pin 1175 slides within second slot 1177 as outer housing 1140 pivots towards a vertical position.

When housing assembly 1100 is removed from the recessed mounting receptacle a sufficient amount, upper bracket 1191 will no longer engage the recessed mounting receptacle and biasing member 1170 will return first engagement pin 1174 to its prior position (e.g., to a position engaging lever arm 1171). In this manner, the desired amount of tilt of outer housing 1140 is maintained after housing assembly 1100 has been removed. With outer housing 1140 removed, a user can remove upper bracket 1191 and replace a light source 1142 (and/or a diffuser or lens 1143) or perform other desired maintenance on housing assembly 1100. When the desired maintenance has been completed, a user can install housing assembly 1100 without manually adjusting the desired degree of tilt of outer housing 1140. The installation process works generally in reverse of the of removal process. For example, the user can push housing assembly 1100 into the recessed mounting receptacle. The recessed mounting receptacle may exert a force on upper bracket 1191 that causes outer housing 1140 to tilt an amount sufficient to allow housing assembly 1100 to be inserted into the recessed mounting receptacle. In this manner, housing assembly 1100 can be removed and installed without disturbing the degree of tilt of outer housing 1140.

Adjustable light fixture 1500 also comprises a second adjustment mechanism 1150 configured to rotate outer housing 1140. Second adjustment mechanism 1150 operates in a similar manner to that of second adjustment mechanism 150 in previously described embodiments. In this embodiment, second adjustment mechanism 1150 comprises a gear member 1155, a biasing member 1157 and a locking member 1159. In this embodiment, biasing member 1157 biases gear member 1155 so that it is normally engaged with locking member 1159. In the embodiment shown, locking member 1159 comprises one or more projections configured to engage the teeth of gear member 1155 and prevent rotation. As shown in the cross section views of FIG. 20-21, gear member 1155 can be pushed up so that it compresses biasing member 1157. Gear member 1155 can be pushed far enough to allow the teeth of gear member 1155 to become disengaged from locking member 1159. Gear member 1155 can then be rotated so that its teeth impart rotation to gear segment 1168, which is coupled to outer housing 1140. In certain embodiments, a tool such as a screw driver or hex-head wrench can be used to both disengage gear member 1155 from locking member 1159 and to rotate gear member 1159. In this manner, second adjustment mechanism 1150 can be used to rotate outer housing 1140.

Additional features are present in adjustable light fixture 1500 that provide for ease of installation and adjustment. For example, referring now to the partial section view of FIG. 23, each side of upper bracket 1191 comprises a flexible projection 1193 that engages a series of indentations 1194 in slots 1192. The adjustable engagement of flexible projection 1193 and indentations 1194 allows a user to adjust the distance between upper bracket 1191 and outer housing 1140 (as well as the distance between upper bracket 1191 and trim plate 1300) to account for dimensional variations in light sources, effects devices or lenses, used in the adjustable light fixture 1500.

Figure 17:
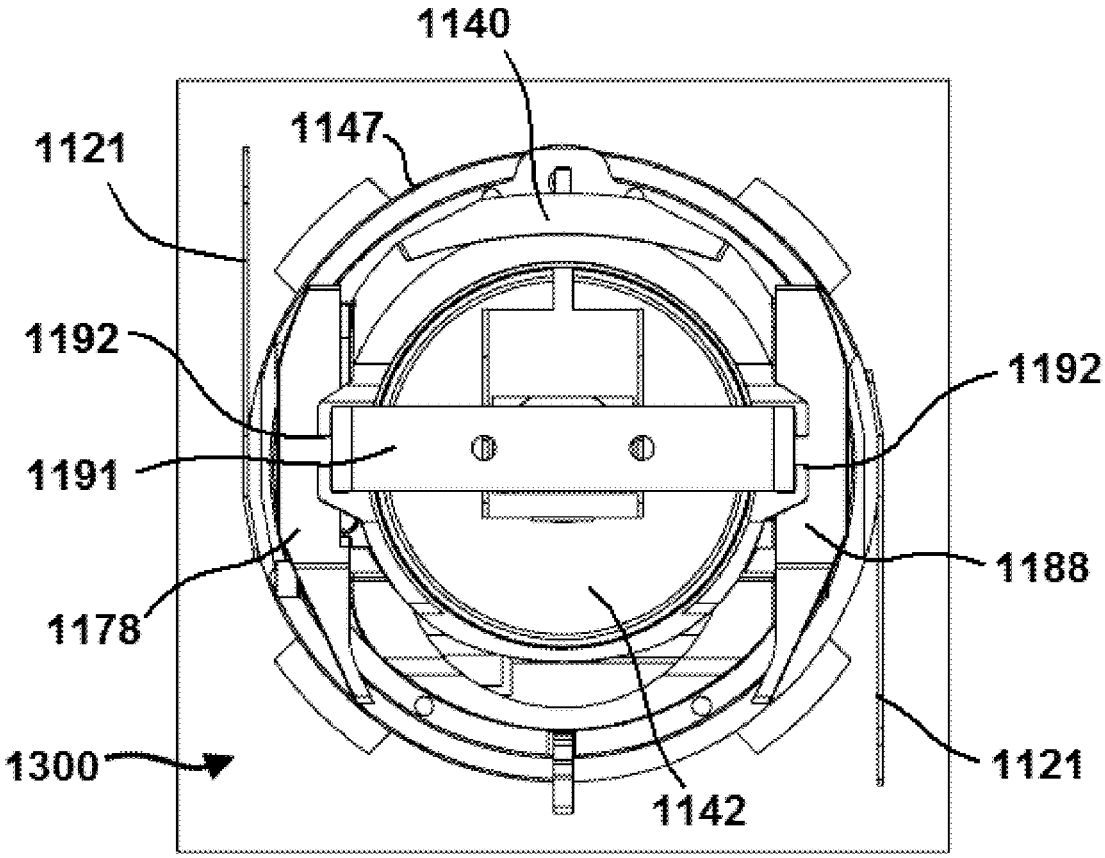
FIG. 17 is a top view of the embodiment of FIG. 13.
Figure 18:
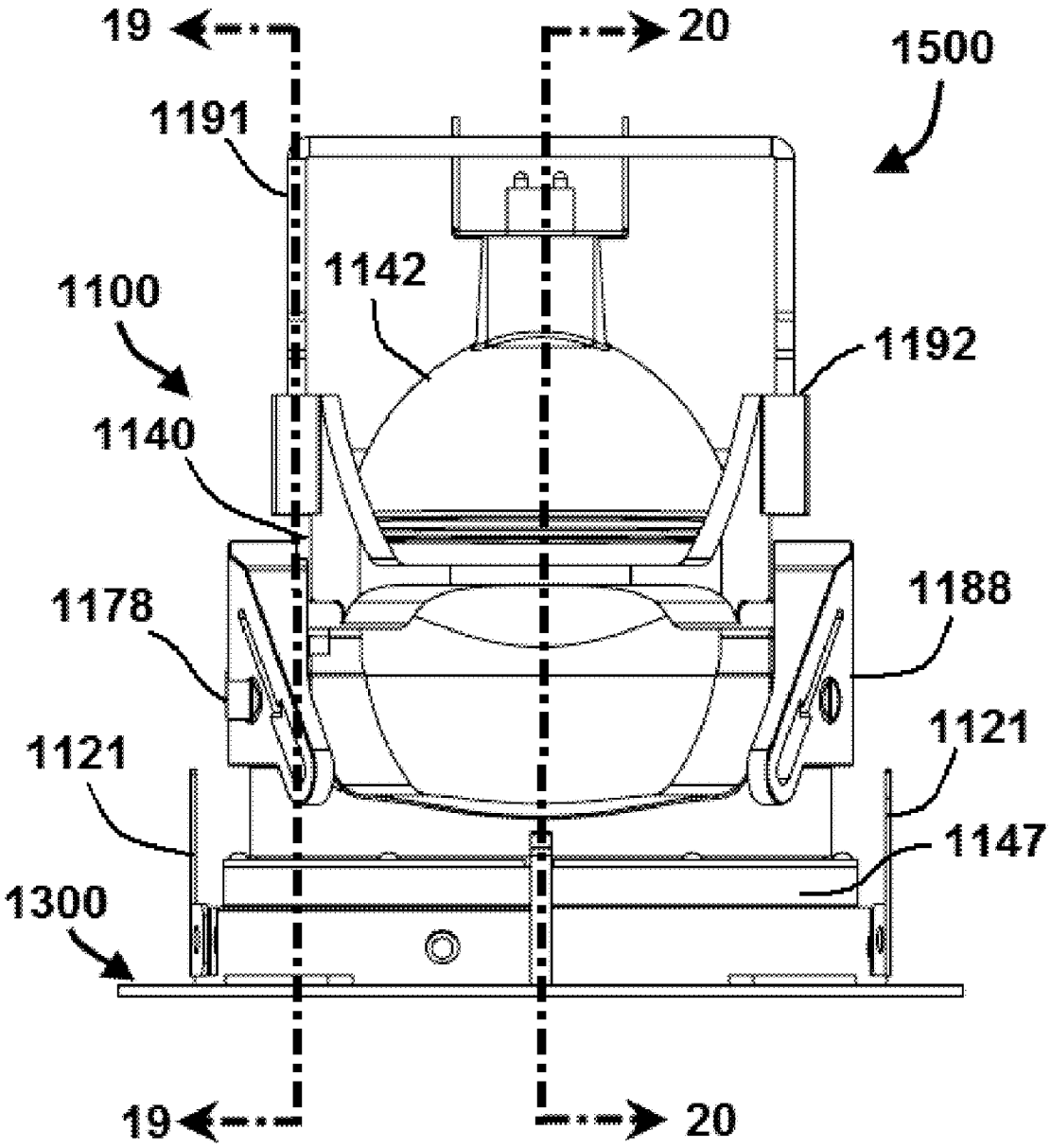
FIG. 18 is a front view of the embodiment of FIG. 13.
Figure 19:
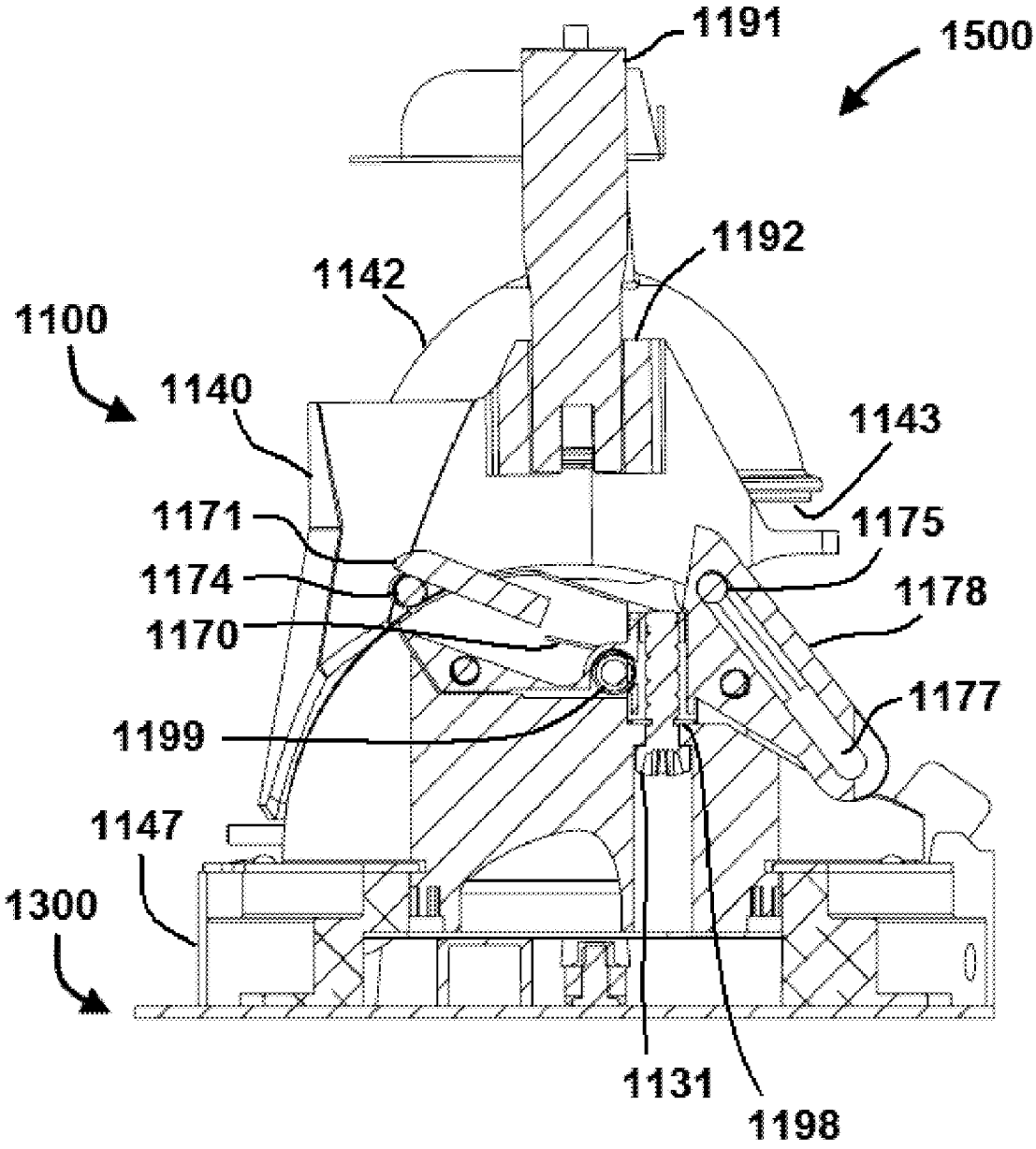
FIG. 19 is a section view taken along the line 19-19 of FIG. 18.
Figure 20:
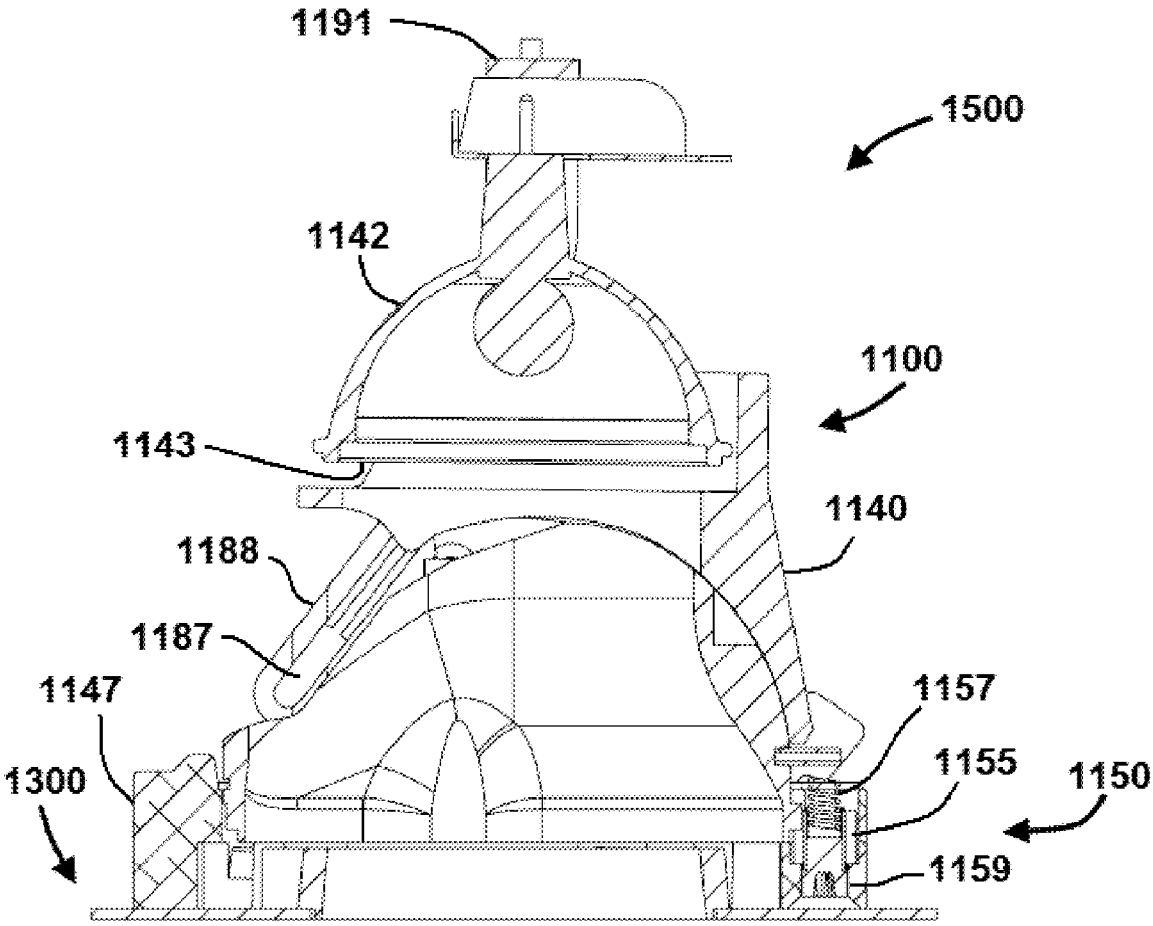
FIG. 20 is a section view taken along the line 20-20 of FIG. 18.
Figure 21:
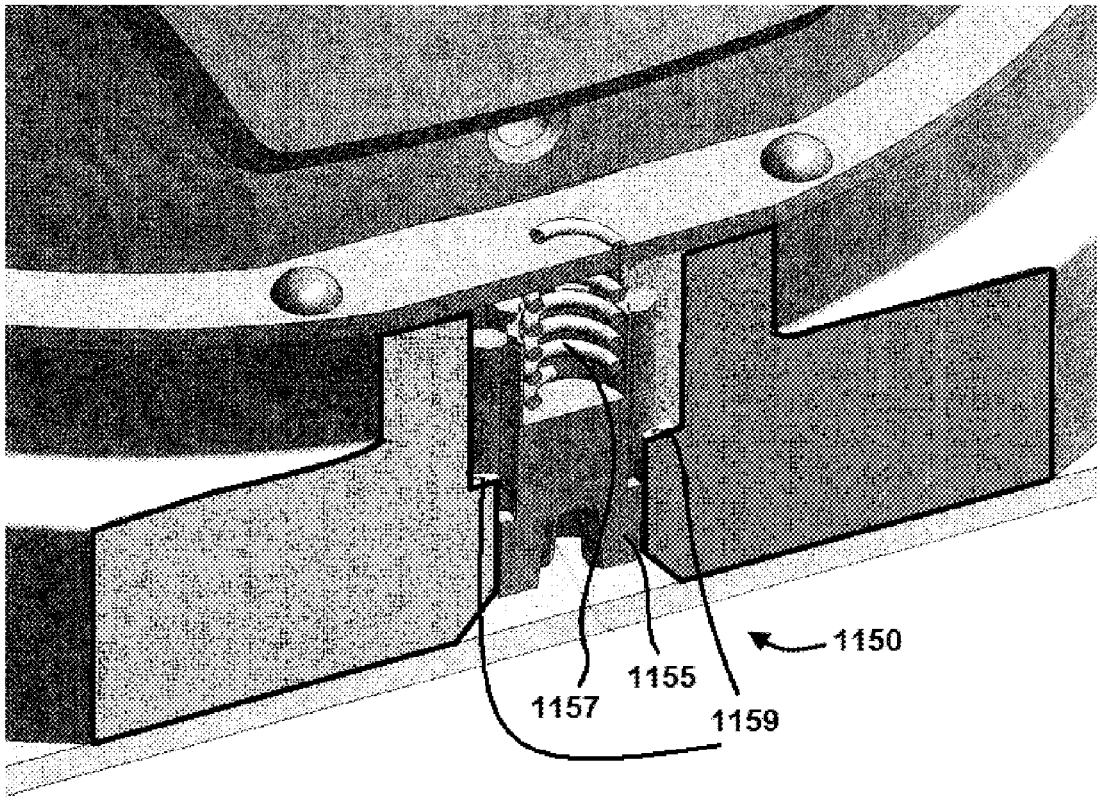
FIG. 21 is a partial section view of the embodiment of FIG. 13.
Figure 22:
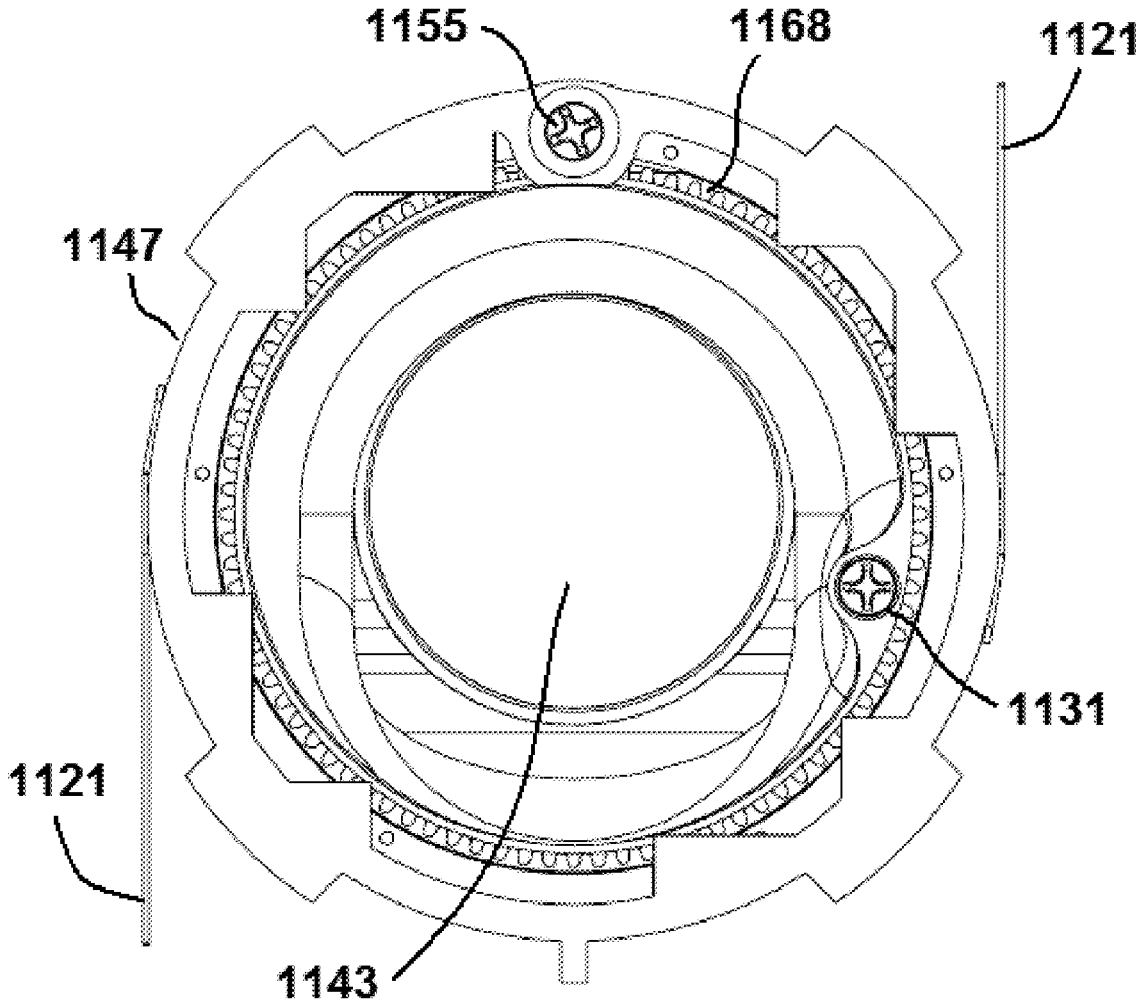
FIG. 22 is a bottom view of the embodiment of FIG. 13.
Figure 23:
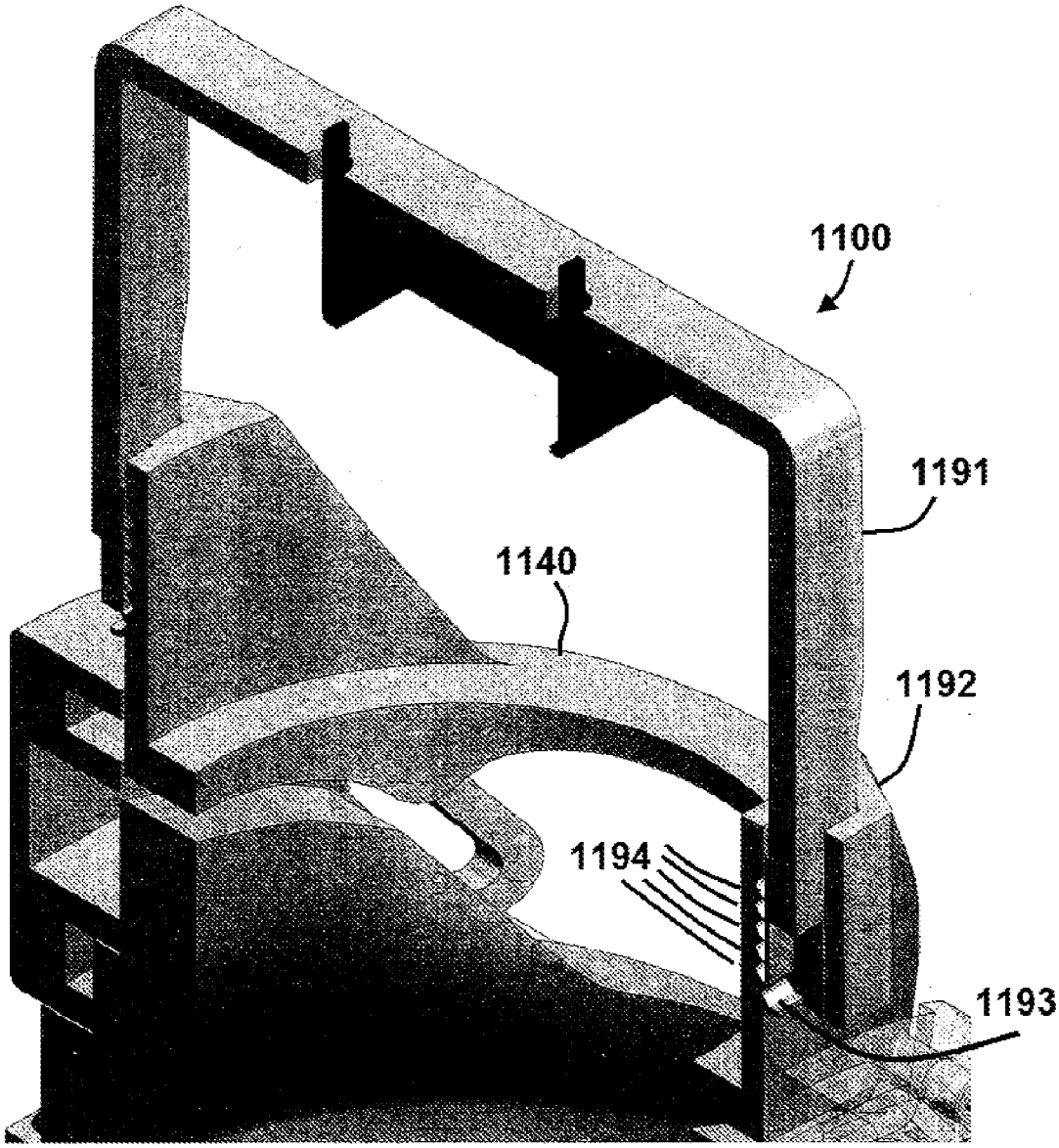
FIG. 23 is a partial section view of the embodiment of FIG. 13.

Adjustable light fixture 1500 also comprises biasing members 1121 that allow adjustable light fixture 1500 to be installed in openings of various depth and diameter. As seen in FIGS. 13-16, biasing members 1121 comprise a curved portion that extends away from trim plate 1300 and toward upper bracket 1191. This curved portion allows biasing member 1121 to act against a recessed mounting receptacle at various axial distances from trim plate 1300, and provides greater axial dimensional tolerance for the recessed mounting receptacles into which adjustable light fixture 1500 can be installed. As shown in FIGS. 17 and 22, biasing members 1121 extend away from the circumference of base ring 1147 providing greater circumferential dimensional tolerance for the recessed mounting receptacles into which adjustable light fixture 1500 can be installed.

The adjustable light fixtures are not intended to be limited to the particular forms disclosed. Rather, they include all modifications, equivalents, and alternatives falling within the scope of the claims. For example, while a square trim plate is shown in the figures, other embodiments may comprise a trim plate that is round, square or any shape. Further, the claims are not to be interpreted as including means-plus- or step-plus-function limitations, unless such a limitation is explicitly recited in a given claim using the phrase(s) "means for" or "step for," respectively.

The invention claimed is:

1. An adjustable light fixture comprising:

a housing assembly comprising an outer housing surrounding a central opening;

a first adjustment mechanism configured to tilt the outer housing, the first adjustment mechanism comprising a first rotating member; and a second adjustment mechanism configured to rotate the outer housing, the second adjustment mechanism comprising a second rotating member, where the first and second rotating members are substantially parallel to one another and substantially parallel to a central axis of the outer housing.

2. The adjustable light fixture of claim 1, where the first and second adjustment mechanisms are accessible when the light fixture is installed in a recessed mounting receptacle.

3. The adjustable light fixture of claim 1, where the first rotating member comprises a first head portion that is configured to rotate, where rotation of the first head portion causes the outer housing to tilt.

4. The adjustable light fixture of claim 3, where the second rotating member comprises a second head portion that is configured to rotate, where rotation of the second head portion causes the outer housing to rotate.

5. The adjustable light fixture of claim 4, where the first and second head portions are on substantially the same plane.

6. The adjustable light fixture of claim 5, where the first and second head portions are configured to be rotated with a tool.

7. The adjustable light fixture of claim 6, further comprising a face plate, the face plate comprising a surface that includes one or more openings configured to allow access to the first and second head portions.

8. The adjustable light fixture of claim 7, where the face plate is configured to remain stationary when an upper portion of the housing assembly rotates.

9. The adjustable light fixture of claim 1, further comprising a trim plate that can be removed while the light fixture is installed, where removal of the trim plate provides access to the first and second adjustment mechanisms.

10. The adjustable light fixture of claim 1, where the first adjustment member comprises a biasing member configured to bias the outer housing to a first tilted position.

11. The adjustable light fixture of claim 10 wherein the outer housing can be tilted to a second tilted position without rotating the first rotating member.

12. The adjustable fixture of claim 11 wherein the outer housing can be tilted from the first tilted position to the second titled position during removal of the adjustable light fixture from a recessed mounting receptacle.

13. The adjustable light fixture of claim 1, where the first adjustment member comprises an alignment bracket with a slot that engages an engagement pin coupled to the outer housing.

* * * * *